US006388212B1

(12) United States Patent
Ishihara et al.

(10) Patent No.: US 6,388,212 B1
(45) Date of Patent: May 14, 2002

(54) PUSH AND ROTARY OPERATING TYPE ELECTRONIC COMPONENT

(75) Inventors: Yukihiro Ishihara; Masaki Sawada, both of Osaka; Tamotsu Yamamoto, Hyogo; Hiroto Inoue, Kyoto, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/666,055

(22) Filed: Sep. 20, 2000

(30) Foreign Application Priority Data

Sep. 20, 1999 (JP) ..... 11-265604

(51) Int. Cl.[7] ..... H01H 3/02
(52) U.S. Cl. ..... 200/18; 200/14; 200/571
(58) Field of Search ..... 200/4, 14, 7, 18, 200/11 TW, 11 G, 567, 571

(56) References Cited

U.S. PATENT DOCUMENTS 5,886,310 A 3/1999 Kataoka et al.
6,049,044 A 4/2000 Mizobuchi
6,194,673 B1 * 2/2001 Sato et al. ..... 200/4
6,211,474 B1 * 4/2001 Takahashi ..... 200/18
6,218,635 B1 * 4/2001 Shigemoto et al. ..... 200/4 X

* cited by examiner

*Primary Examiner*—Renee Luebke
(74) *Attorney, Agent, or Firm*—Wenderoth, Lind & Ponack, L.L.P.

(57) ABSTRACT

A push and rotation operating type electronic component that allows for rotary manipulation in a tangential direction of a peripheral surface of a cylindrical operating knob projecting from a control surface of an apparatus, and also for pushing manipulation in a direction toward a central axis of rotation of the knob. The electronic component provides for a reduction in overall dimensions of a main portion, thereby reducing a height size of an enclosure of the end-use apparatus, smooth movement to a depressing manipulation, and easy to assemble. It is provided with a rotary encoder comprising a cylindrical rotary body with stepped periphery having a cylindrical knob portion of large diameter at a center, and rotatably retained in a frame supported also rotatably on a substrate and flexible contact bars retained by the substrate and in resilient contacts with a movable contact provided on a peripheral surface of a cylindrical axle besides the knob portion, and a push switch of a self-restoring type disposed on the substrate and activated by a turning movement the frame.

16 Claims, 17 Drawing Sheets

PUSH AND ROTARY OPERATING TYPE ELECTRONIC COMPONENT

FIELD OF THE INVENTION

The present invention relates to a push and rotary operating type electronic component employed mainly in a computer peripheral such as a mouse and the like, a communication terminal apparatus such as a cellular phone and the like, a vehicle-mounted electric device, and so on. In particular, the invention relates to a push and rotary operating type electronic component that allows for rotary manipulation of a peripheral surface of a cylindrical operating knob projecting from a control surface of the apparatus in a tangential direction, and also for push manipulation in a direction toward a central axis of rotation of the knob.

BACKGROUND OF THE INVENTION

A rotary encoder equipped with a push switch (hereinafter referred to simply as "REPS"), such as one shown in a general perspective view of FIG. 15, has been hitherto known, as this kind of push and rotary operating type electronic component is prior art.

FIG. 16 is a cross-sectional side view of the REPS. With reference to FIG. 15 and FIG. 16, the REPS of the prior art will be described hereinafter.

The REPS of the prior art comprises a mounting substrate 1 having contact points, a rotary encoder 2 disposed on one side of the mounting substrate 1 having contact points, as a rotary operation part, and a push switch 3 disposed on the other side of the mounting substrate 1 having contact points, as a push operation part.

The rotary encoder 2 is held on the mounting substrate 1 in a manner such that it is movable within a certain range in a vertical direction (the direction shown by arrows V in FIG. 15 and FIG. 16). Further, the push switch 3 is fixed to the mounting substrate 1 so as not to move.

As shown in a general perspective view of FIG. 17, the mounting substrate 1 having contact points is provided with a recess 5 formed in a plate-like plastic body having guide rails 4 for the rotary encoder 2 to move along, another recess 6 for fixing the push switch 3, three terminals 7 connected to their respective contact plates 8 for leading an electric signal of the rotary encoder 2 to an outside, and a support leg 1A positioned on a mount surface 1B at a lower end for installation of the REPS on a wiring board of an apparatus.

As shown in the cross-sectional side view of FIG. 16, the rotary encoder 2 comprises a sliding contact body 9 made of plastic, inserted in the recess 5 of the mounting substrate 1 with contact points, three flexible contact bars 10 secured to the sliding contact body 9 by insertion molding, a cylindrical axle 15 mounted on the sliding contact body 9, a discoidal operating knob 12 mounted on the cylindrical axle 15 in a rotatable manner, a rotary body 14 made of plastic mounted on an inner surface of the discoidal operating knob 12, and a radially-oriented movable contact 13 secured to the rotary body 14.

The sliding contact body 9 is fitted in the recess 5 and retained with the guide rails 4 in a manner that it is movable within a certain range in a vertical direction (the direction shown by the arrow V).

FIG. 19 is a plan view depicting one aspect of the three flexible contact bars 10 in contact with the radially-oriented movable contact 13. As shown in FIG. 19, the three flexible contact bars 10 consisting of a common flexible contact bar and two signaling flexible contact bars, all fixed to the sliding contact body 9, are in resilient contact with an annular contact portion 13A and a radial contact portion 13B of the radially-oriented movable contact 13. In other words, the three flexible contact bars 10 are so arranged as to be in contact with the radially-oriented movable contact 13 secured to the rotary body 14, which is rotatable about the cylindrical axle 15. Hence, the three flexible contact bars 10 slide on the annular contact portion 13A and the radial contact portion 13B, while maintaining resilient contacts therewith, when the operating knob 12 is rotated. The above operation causes the rotary encoder 2 to generate an electric signal.

Furthermore, three flexible contacts 11 in electrical continuity with their respective flexible contact bars 10 are so arranged such that they maintain contact with the three contact plates 8 positioned on the mounting substrate 1. Therefore, the electric signal generated in the rotary encoder 2 is led to the terminals 7 through the flexible contacts 11 and the contact plates 8.

In addition, a leaf spring 16, mounted on a lower end portion of the sliding contact body 9, stays in resilient contact with projecting studs 17 (refer to FIG. 17) of the mounting substrate 1. In this structure, the leaf spring 16 provides a biasing force to keep the rotary encoder 2 in a position away from the push switch 3 in a normal state.

The push switch 3 is fitted and secured in the recess 6 (shown in FIG. 17) in an opposite surface of the mounting substrate 1 with respect to the rotary encoder 2. The push switch 3 is arranged so that an actuating button 18 thereof is in contact with a pushing portion 15A of the cylindrical axle 15 of the rotary encoder 2, as shown in FIG. 16. Terminals 19 to deliver an electric signal of the push switch 3 to an outside project downward.

The REPS of the prior art is constructed as described above. FIG. 18 is a partially sectioned side view depicting an example in which this REPS is mounted in an enduse apparatus. The mounting substrate 1 having contact points is mounted on a wiring board 20 with the support leg 1A, as shown in FIG. 18, so as to keep the mount surface 1B at a bottom end thereof in close contact with a surface of the wiring board 20. In addition, the terminals 7 of the rotary encoder 2 and the terminals 19 of the push switch 3 are inserted into mounting holes 21 and 22 in the wiring board 20 of the apparatus, and soldered. Also, the REPS is mounted in the apparatus in a manner that a peripheral rim 12A, serving as an operating portion of the discoidal operating knob 12, protrudes from a control surface 23 on an upper enclosure of the apparatus.

The REPS of the prior art constructed as discussed above operates in a manner, which will be described hereinafter.

First, the rotary encoder 2 will be described. An operator rotates the discoidal operating knob 12 by applying a force on the peripheral rim 12A of the operating knob 12 in the tangential direction (the direction of an arrow H shown in FIG. 15). This rotary motion causes the rotary body 14 to rotate about the axle 15. Accordingly, the three flexible contact bars 10 slide on the annular contact portion 13A and the radial contact portion 13B of the radially-oriented movable contact 13 secured to the rotary body 14, while maintaining resilient contact therewith. As a result, the rotary encoder 2 generates an electric signal corresponding to a direction of the rotation of the operating knob 12, so as to function as a rotary type encoder. This electric signal is transferred to the contact plates 8 on the mounting substrate 1 from the flexible contact bars 10 via the three flexible contacts 11. The electric signal is further transferred to a circuit on the wiring board 20 of the apparatus through the terminals 7 for external connections.

The push switch 3 will be described next. The operator applies a depressing force on the peripheral rim 12A of the discoidal operating knob 12 in a direction toward the central axis of rotation (the direction of arrows V1 shown in FIG. 16 and FIG. 18) against the biasing force of the leaf spring 16, which provides the force to push the rotary encoder 2 upward. The depressing force shifts the entire rotary encoder 2 in the direction of the arrow V1 along the guide rails 4 of the mounting substrate 1 having contact points. This movement causes the pushing portion 15A of the cylindrical axle 15 to depress the actuating button 18. The depressed motion of the actuating button 18 actuates the push switch 3 to thereby generate an electric signal. The electric signal is delivered through the terminals 19 to the circuit on the wiring board 20 in the apparatus. When the depressing force applied on the operating knob 12 is removed thereafter, the rotary encoder 2 is pushed back and returns to its original position by a resilient restoring force of the leaf spring 16. What has been described above is how the REPS of the prior art operates.

However, the REPS of the prior art has a large diameter, since the radially-oriented movable contact 13 in the REPS has the radial contact portion 13B arranged radially around the annular contact portion 13A. Therefore, an outer diameter of the rotary body 14 is also large.

Consequently, the discoidal operating knob 12 to operate the rotary body 14 needs to be made even larger in size. Moreover, the mounting substrate 1 having contact points must be kept from protruding beyond the control surface 23, as shown in FIG. 18, when mounting the REPS on the end-use apparatus. Furthermore, a clearance is required between the wiring board 20 and the peripheral rim of the operating knob 12 so that the operating knob 12 is rotatable. A wide space is needed between the control surface 23 and the wiring board 20 in the apparatus for this reason. Accordingly, there has been a problem that an enclosure of the apparatus equipped with the REPS of the prior art becomes bulky in height.

In the REPS, the rotary encoder 2 is mounted in a vertically movable manner at one side of the mounting substrate 1 having contact points. The push switch 3 is positioned on the other side. This structure has given rise to another problem in that depressing manipulation of the operating knob 12 yields a twisting force against the guide rails 4 of the mounting substrate 1, thereby causing an unstable feeling when manipulated. In addition, the REPS of the prior art is provided with the flexible contacts 11 and the contact plates 8 to deliver the electric signal produced by the rotary encoder 2. Therefore, another problem with the REPS of the prior art has been that it is difficult to assemble and costly, due to the large number of resilient contact members and sliding contact points.

SUMMARY OF THE INVENTION

The present invention is intended to obviate the foregoing problems of the past by realizing a reduction in diameter of a rotary operation part and a discoidal operating knob, and thereby reducing a height size of an enclosure of an end-use apparatus. In addition, this invention aims at providing a push and rotary operating type electronic component that is smooth in depressing manipulation, small in a number of structural components, easy to assemble, and less expensive.

To achieve the above purpose, the push and the rotary operating type electronic component of this invention comprises a rotary operation part, and a self-restoring type push switch.

The above rotary operation part comprises a substrate made of an insulation material, a quadrangular frame provided with an axial pin on one side, and supported rotatably by a frame support formed on the substrate, a cylindrical rotary body with a stepped periphery, comprising a cylindrical axle of small diameter having a movable contact on a peripheral surface thereof and a large diameter portion serving-as a knob portion, the rotary body retained rotatably in the quadrangular frame and a flexible contact bar retained by the substrate in a manner to keep resilient contact with the movable contact provided on the peripheral surface of the cylindrical axle of small diameter of the rotary body.

The self-restoring type push switch is disposed on the substrate, and it is actuated when depressed by a turning movement of the quadrangular frame.

The foregoing structure can thus attain a reduction in diameter of the operating knob and a height size of an enclosure of the end-use apparatus, and realize a push and rotary operating type electronic component that is smooth in depressing manipulation, small in number of the structural components, easy to assemble, and less expensive.

The quadrangular frame is so composed such that a projection located near an end portion of another side opposite the side where the axial pin is provided, engages in a restraining hole in the substrate. This structure can restrict a turning angle of the quadrangular frame.

The rotary body comprises a cylindrical knob portion of a large diameter, formed of plastic resin having a center hole, and a cylindrical axle of a small diameter provided with a movable contact on a peripheral surface thereof.

The cylindrical axle is inserted into the center hole of the knob portion, and connected with it. With this structure, the rotary body consisting of the knob portion of large diameter, of which the peripheral surface is subject to manipulation, and the cylindrical axle of small diameter having the movable contact on its peripheral surface can be formed highly precisely and less expensively. In addition, this structure is easily adaptable for alterations in diameter, shape and color of the knob portion, a change in the movable contact for a variation of electric signals, and so on.

The cylindrical axle of the rotary body is retained rotatably at both sides near ends of the knob portion by two opposite sides of the quadrangular frame. Furthermore, the movable contact of the cylindrical axle is positioned at an exterior side of the two sides of the quadrangular frame that holds the cylindrical axle rotatably. The movable contact, flexible contact bars in contact resiliently therewith, and their vicinities are enclosed with a cover. In other words, the contact members are separated by the quadrangular frame from the knob portion manipulated by a hand of an operator, and enclosed with the cover. This structure maintains the contact members free from dust, and improves reliability.

DETAILED DESCRIPTION OF THE EXEMPLARY EMBODIMENTS

Referring now to the accompanying figures, push and rotary operating type electronic components ("REPS") of the exemplary embodiments of this invention will be described hereinafter, using certain examples of the REPS used heavily in the latest computer peripherals, communication terminal apparatuses, and the like.

First Exemplary Embodiment

Figure 1:
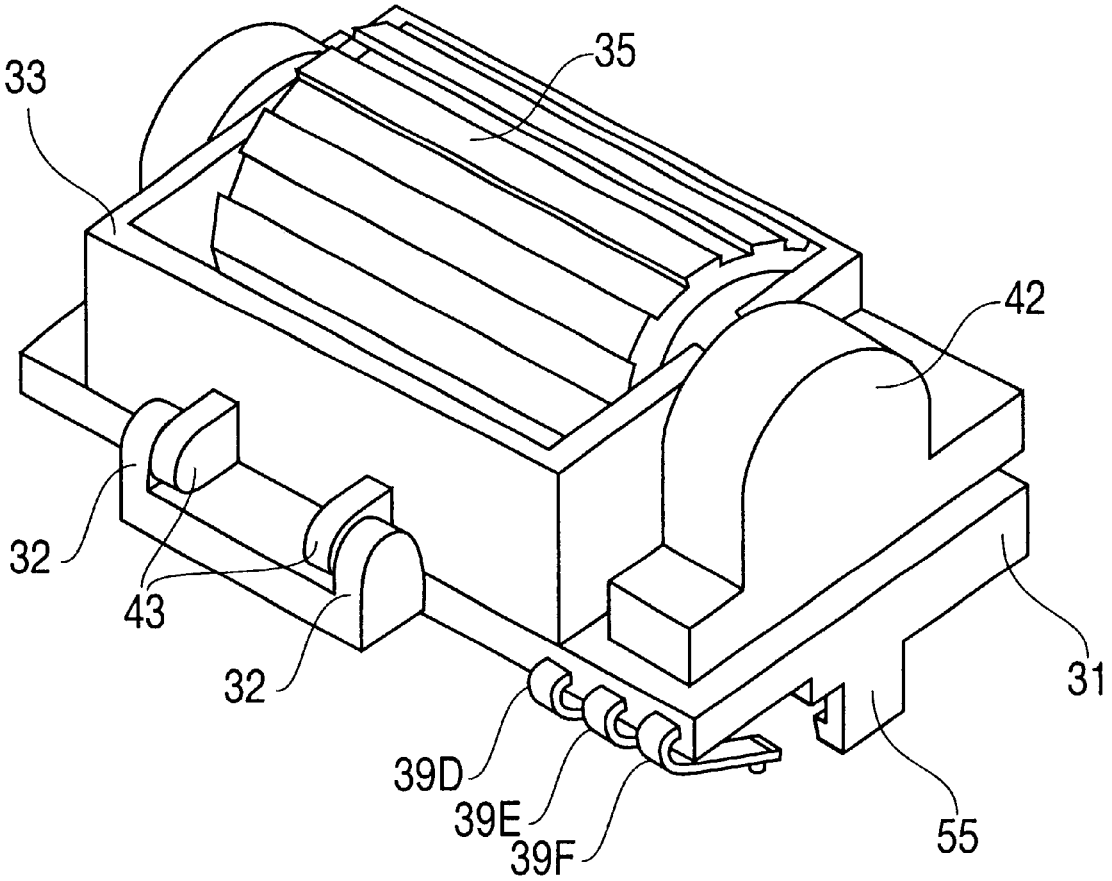
FIG. 1 is a general perspective view of a REPS of a first exemplary embodiment of the present invention.
Figure 2:
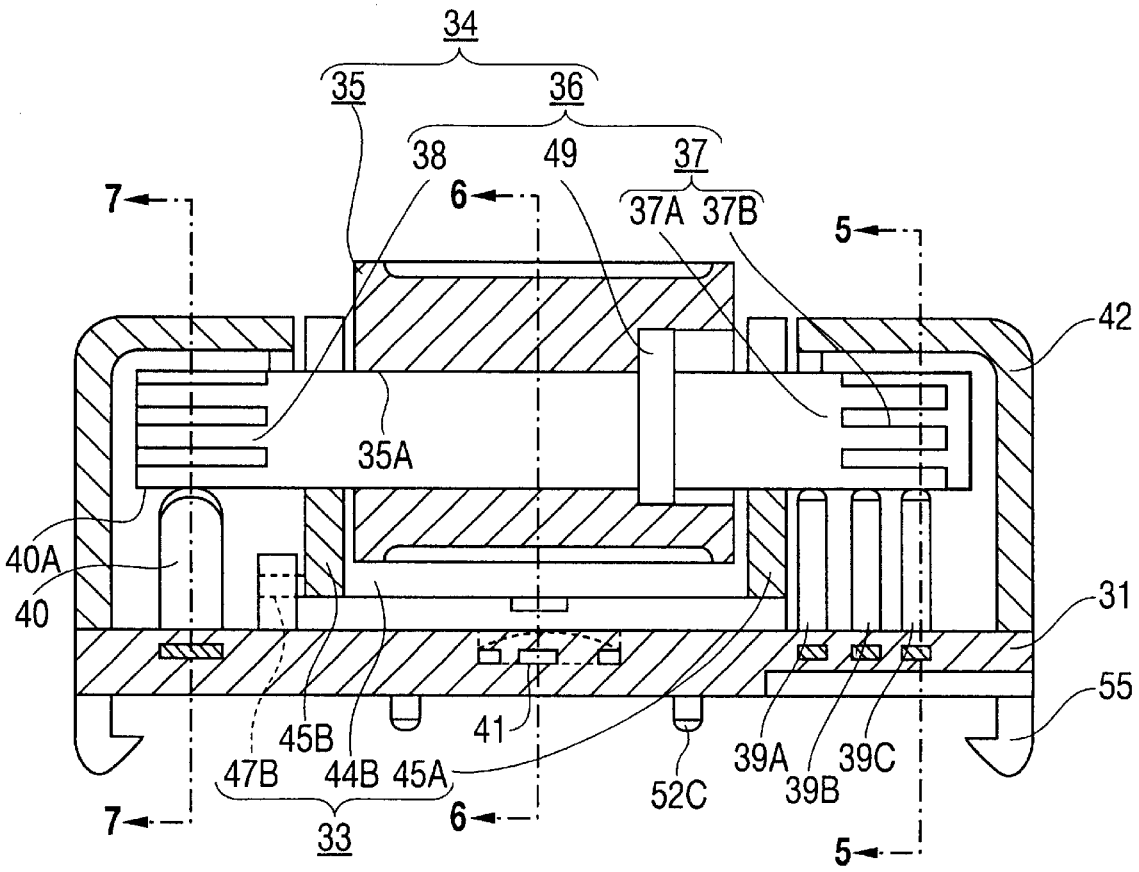
FIG. 2 is a sectional view of an essential portion of the REPS depicted in FIG. 1, as viewed from a front side.
Figure 3:
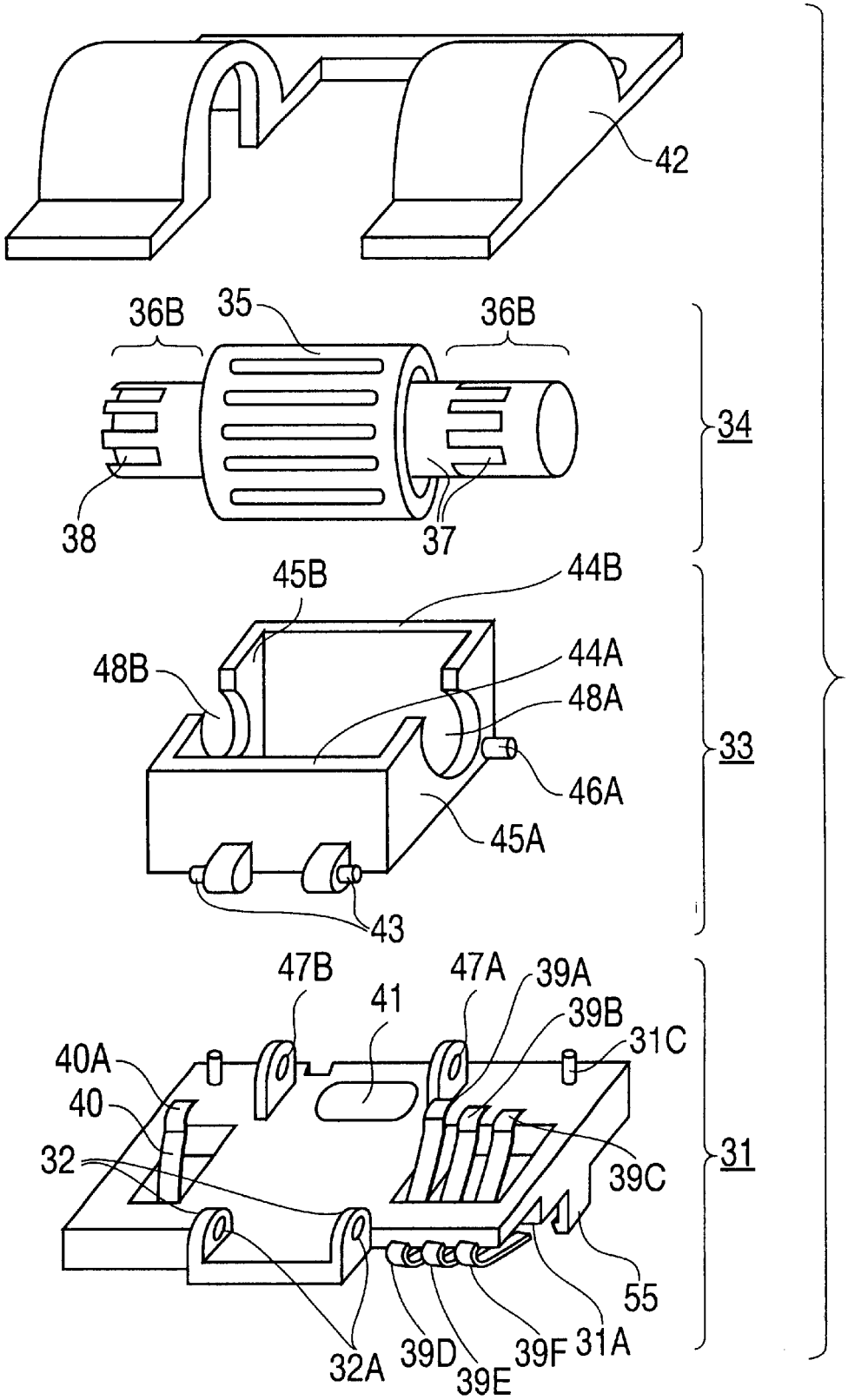
FIG. 3 is an exploded perspective view of the REPS shown in FIG. 1.

FIG. 1 is a general perspective view of a REPS of a first exemplary embodiment of the present invention, FIG. 2 is a sectional view of an essential portion of the REPS shown in FIG. 1, as viewed from a front of the REPS, and FIG. 3 is an exploded perspective view of the REPS shown in FIG. 1.

As shown in FIG. 1, 2, and 3, the REPS comprises a substrate 31 made of insulation resin, provided with a plurality of flexible contact bars, a quadrangular frame 33 supported rotatably by a pair of frame supports 32 formed on the substrate 31, a rotary body 34 having a movable contact member, retained rotatably by the quadrangular frame 33, a push switch 41 disposed on the substrate 31 and a cover 42 for protecting a plurality of a flexible contact bars and a movable contact member from dust.

The substrate 31 retains three flexible contact bars 39A 39B and 39C, and a plate spring 40 provided with a detent 40A.

The rotary body 34 is formed in such a configuration as having a cylindrical knob portion 35 of large diameter in its center, and cylindrical axles 36A and 36B of small diameter at both of its sides. Therefore, the rotary body 34 has a cylindrical shape with a stepped-periphery. The cylindrical axle 36A is provided with a movable contact 37 around a peripheral surface of it, and the cylindrical axle 36B is provided with an annularly undulated surface 38. The movable contact 37 is in contact resiliently with the three flexible contact bars 39A, 39B and 39C retained by the substrate 31. The annularly undulated surface 38 is kept in resilient contact with the detent 40A of the plate spring 40 extending from the substrate 31.

The substrate 31 and the rotary body 34 constitute a rotary encoder, that is, a rotary operation part.

The frame 33 comprises a side 44A having axial pins 43, an opposite side 44B, and two sides 45A and 45B facing against each other, and connecting orthogonally to the sides 44A and 44B, as shown in FIG. 3. The axial pins 43 on the side 44A are inserted into the support holes 32A in the pair of frame supports 32 formed on the substrate 31, so as to be supported rotatably. In addition, projections 46A and 46B formed at both ends of the side 44B facing the side 44A are inserted respectively in restraining holes 47A and 47B provided in the substrate 31. Therefore, a range of turning angles of the frame 33 is restricted accurately by the restraining holes 47A and 47B.

The push switch 41 disposed on the substrate 31 operates when it is depressed by a turning movement of the frame 33. The push switch 41 is a push switch of self-restoring type.

The cover 42 is placed to cover the movable contact 37, the flexible contact bars 39A, 39B and 39C, and their vicinities, to protect them from dust, thereby improving reliability of the contact members.

The structure described above realizes the REPS of this exemplary embodiment to be small in size, and less expensive.

The frame 33 also has retaining slots 48A and 48B, each having an opening at an upper side, formed in the two sides 45A and 45B at their respective center portions, as shown in FIG. 3. The cylindrical axles 36A and 36B of the cylindrical rotary body 34 having stepped-periphery are press-fit from the upper side into the retaining slots 48A and 48B. The retaining slots 48A and 48B have their openings slightly smaller in width than diameters of the cylindrical axles 36A and 36B. Hence, the rotary body 34 can be held rotatably in the frame 33.

As shown in FIG. 2, the rotary body 34 is composed of the cylindrical axles 36 of small diameter having the movable contact 37 inserted into the center hole 35A of the cylindrical knob portion 35 having large diameter, formed of plastic resin, and connected together. FIG. 4 shows a process of forming the rotary body 34.

Figure 4A:
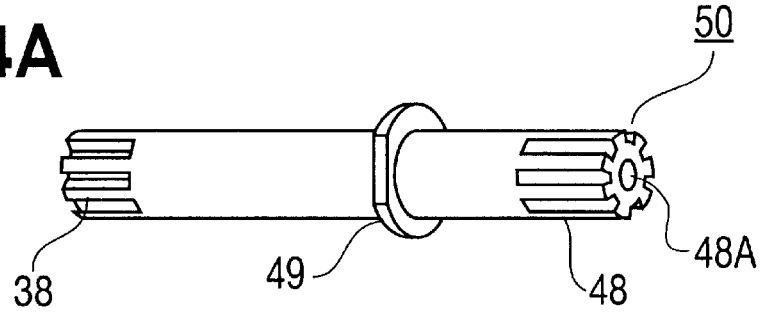
FIGS. 4A, 4B, 4C, and 4D are explanatory drawings illustrating a process of forming a rotary body of the REPS shown in FIG. 1.

First, a metal rod is fabricated by header processing to form a cylindrical metal axle 50 having annularly undulated surfaces 38 and 48 at two ends thereof and a non-circular collar 49 extending from a generally mid portion thereof, as shown in a general perspective view of FIG. 4A. The undulated surfaces 38 and 48 are formed analogously in angular intervals of their ridges and ditches with respect to each other.

The ditches of the annularly undulated surface 48 are then filled with insulation resin of a certain kind by outsert molding. This plastic molding produces a comb-tooth shaped movable contact 37B having conductive areas and insulated areas arranged alternately at predetermined angular intervals on the peripheral surface, as shown in a general perspective view of FIG. 4B. Accordingly, the cylindrical axle 36 having a cylindrical movable contact 37A and the comb-tooth shaped movable contact 37B is now formed. The cylindrical movable contact 37A and conductive areas of the comb-tooth shaped movable contact 37B are electrically continuous.

Figure 4B:
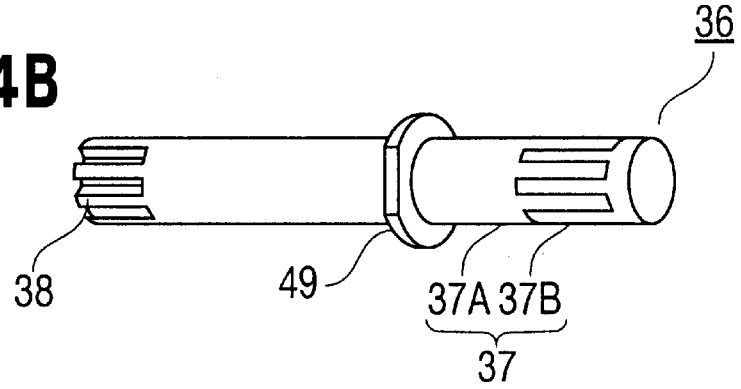

The plastic resin that forms the insulated areas covers an end surface of the cylindrical metal axle 50 entirely and in a circular shape, including a center hole 48A in the end next to the annularly undulated surface 48, as shown in. FIG. 4B. Accordingly, the plastic resin that forms the insulated surfaces of the comb-tooth shaped movable contact 37B bonds rigidly with the annularly undulated surface 48.

Figure 4C:
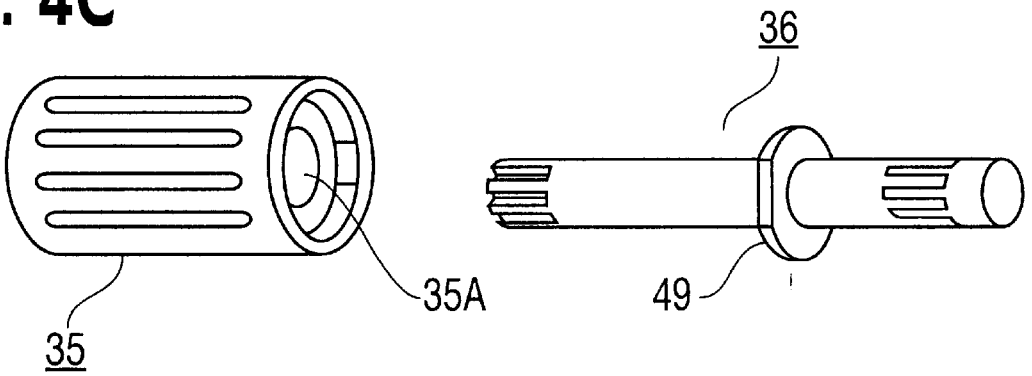
Figure 4D:
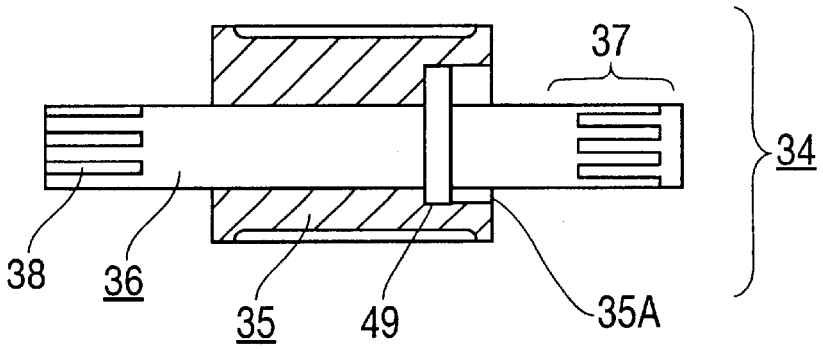

Subsequently, the cylindrical axle 36, constructed as above, is inserted into the center hole 35A in the cylindrical knob portion 35 of large diameter formed separately with plastic resin, as shown in a general perspective view of FIG. 4C. The knob portion 35 is provided with a non-circular opening within the center hole 35A in a like shape as that of the non-circular collar 49. The knob portion 35 and the cylindrical axle 36 are connected in a manner such that they rotate unitedly by engaging the non-circular collar 49 of the cylindrical axle 36 with the non-circular opening in the center hole 35A of the knob portion 35. This completes the cylindrical rotary body 34 having stepped-periphery, as shown in a sectioned front view of FIG. 4D.

As described, the rotary body 34 can be constructed precisely and less expensively by separately forming the cylindrical knob portion 35 of large diameter and the cylindrical axle 36 having the movable contact 37, etc. on the peripheral surface thereof. In addition, the rotary body 34 of this exemplary embodiment can be adapted easily to alterations in outer diameter, shape and color of the knob portion, a change in the movable contact for a variation of electric signals, and so on.

The rotary body 34 constructed as above is retained rotatably in position by the two opposite sides 45A and 45B, of the frame 33, as described above.

Figure 5:
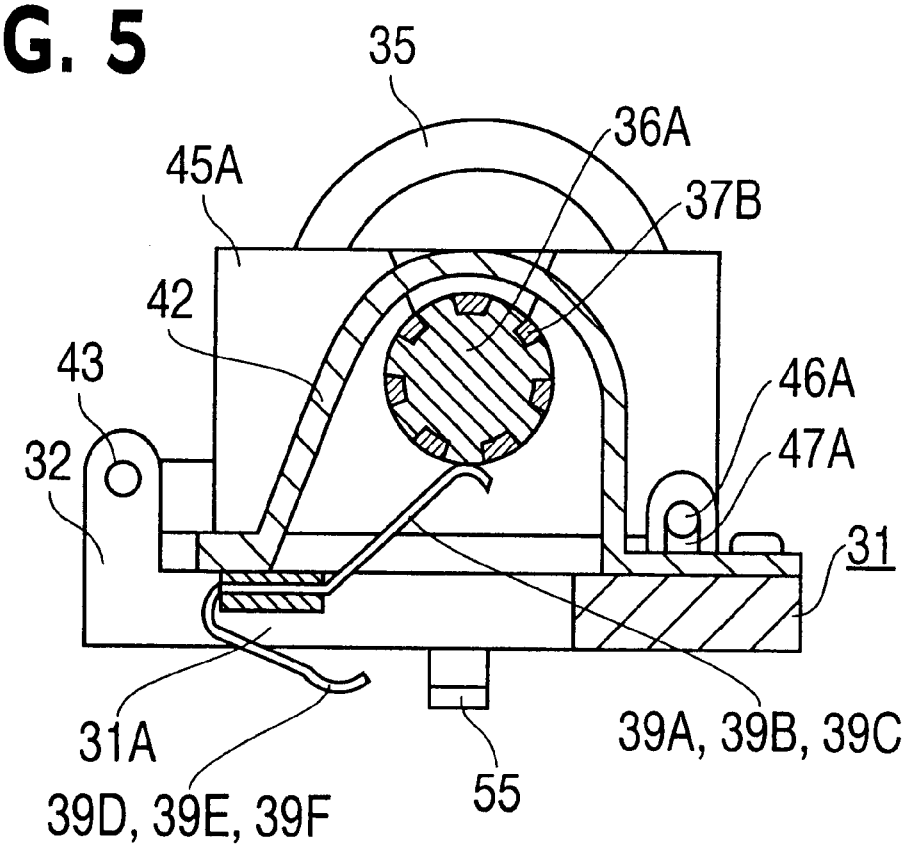
FIG. 5 is a sectional view taken along a line 5—5 in FIG. 2.

FIG. 5 is a sectional view taken along a line 5—5 in FIG. 2. FIG. 5 also shows a positional relation among the cylindrical movable contact 37A, the movable contact 37B serving as a contact for signals, and the three flexible contact bars 39A, 39B and 39C retained by the substrate 31. Each of the flexible contact bars 39A, 39B and 39C is formed of thin resilient sheet metal. As shown in FIG. 5, the flexible contact bar 39A for a common contact point makes resilient contact with the cylindrical movable contact 37A from underside thereof, and both of the two flexible-contact bars 39B and 39C for signal contact points make resilient contact with the comb-tooth shaped movable contact 37B also from the underside. Lengths of the two flexible contact bars 39B and 39C for the signal contact points are differentiated slightly from each other by a predetermined dimension. Therefore, the two points of resilient contact for signaling are slightly shifted with respect to each other by a predetermined distance.

As described, a contact portion of the rotary encoder for generating electric signals is composed of the movable contacts 37A and 37B of the rotary body 34, and the flexible contact bars 39A, 39B and 39C retained by the substrate 31.

There are disposed in predetermined positions at one edge of the substrate 31 three connection terminals 39D, 39E and 39F having flexibility, each connected integrally with the flexible contact bars 39A, 39B and 39C respectively. The connection terminals 39D, 39E and 39F are terminals for leading the electric signals of the rotary encoder. In this instance, a flexible member having the flexible contact bar 39A at one end and the connection terminal 39D at the other end is bent toward a shallow recess of a clearance space 31A provided in a flat underside surface of the substrate 31, as shown in FIG. 5. The connection terminal 39D, formed as a part of the flexible member, projects downward below the underside surface of the substrate 31. Other flexible members provided respectively with the flexible contact bars 39B and 39C also are shaped like shapes as the flexible member having the flexible contact bar 39A.

Figure 6:
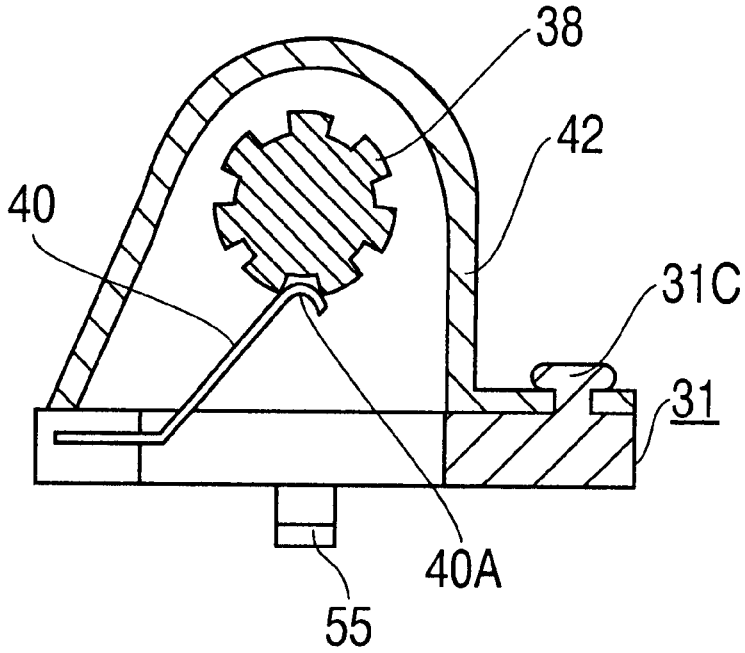
FIG. 6 is a sectional view taken along a line 6—6 in FIG. 2.

FIG. 6 is a sectional view taken along a line 6—6 in FIG. 2. As shown in FIG. 6, the detent 40A on the plate spring 40 extending from the substrate 31 stays in resilient contact to an underside of the annularly undulated surface 38 provided on the cylindrical axle 36B of the rotary body 34. They are so constructed such that the flexible contact bars 39B and 39C remain in contact with the movable contact 37B at points within the insulated surface, when the detent 40A is caught in one of the ditches of the annularly undulated surface 38. In other words, the flexible contact bars 39B and 39C are not in a state of continuous electrical contact with the movable contact 37.

As described above, the three flexible contact bars 39A, 39B and 39C, and the plate spring 40 all bias the rotary body 34 in an upwardly thrusting direction from below. Therefore, the frame 33 retaining the rotary body 34 is normally biased to be in a stable state at an upper end position within the range of the turning angle.

The movable contact 37, the flexible contact bars 39A, 39B and 39C, the annularly undulated surface 38, the plate spring 40, and their vicinities are covered with the cover 42 to be dustproof. The cover 42 for dustproofing is mounted on both sides of the knob portion 35 with a fixing stud 31C to the substrate 31.

Figure 7:
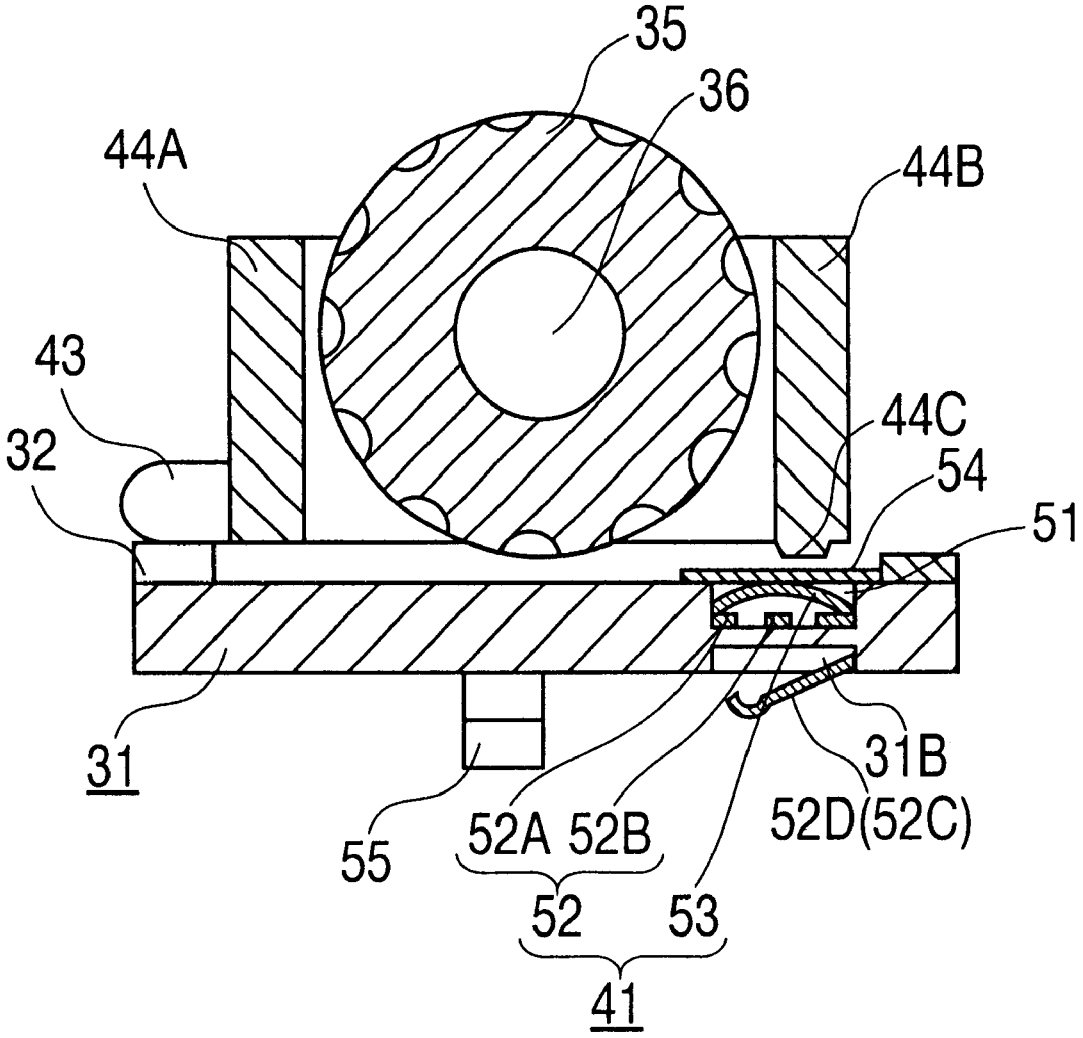
FIG. 7 is a sectional view taken along a line 7—7 in FIG. 2.

FIG. 7 is a sectional view taken along a line 7—7 in FIG. 2. As shown in FIG. 7, the push switch 41 is disposed on the substrate 31 in a position corresponding to the side 44B of the frame 33.

The push switch 41 comprises a switch 52 comprising an outer stationary contact 52A and a center stationary contact 52B placed by insert-molding within a circular recess 51 provided in the substrate 31, a discoidal dome-shaped movable contact 53 made of thin resilient sheet metal placed with its perimeter on the outer stationary contact 52A, and a flexible insulation film 54 covering the circular recess 51 provided in the substrate 31 and an upper area of the discoidal dome-shaped movable contact 53.

There is normally a predetermined contact spacing between a center portion of the dome-shaped movable contact 53 and the center stationary contact 52B. There is no electrical continuity between the outer stationary contact 52A and the center stationary contact 52B, and the switch 52 is therefore in an OFF state. When an operator pushes the knob portion 35 in a direction toward its center axis, a depressing boss 44C on a lower surface of the side 44B of the frame 33 depresses the dome-shaped movable contact 53 through the insulation film 54. This depressing force deforms the dome-shaped movable contact 53 in such a manner as to contact the center stationary contact 52B. The deformation causes electrical continuity between the outer stationary contact 52A and the center stationary contact 52B through the dome-shaped movable contact 53. In other words, the switch 52 turns on. On the other hand, when the operator removes the depressing force from the knob portion 35, the dome-shaped movable contact 53 restores itself into its original shape. That is,the switch 52 turns off. The dome-shaped movable contact 53 provides for a click feel (tactile response) when it deforms and restores. The push switch 41 is constructed as described above, and it thus, so functions.

The foregoing structure makes it possible to provide the push switch 41 of high-performance, self-restoring type having the ability to yield a click feel during operation with compactness in size and high accuracy in dimension relative to other constituent members.

There are provided in predetermined positions of the substrate 31, switch connection terminals (52C and 52D) connected to their respective stationary contacts (52A and 52B). The connection terminals 52C and 52D lead electric signals of the push switch 41. In this instance, a flexible member having the stationary contact 52A at one end and the connection terminal 52C at the other end is bent toward the shallow recess of clearance space 31B provided in the flat underside surface of the substrate 31. The connection terminal 52C formed as a part of the flexible member protrudes downwardly below the underside surface of the substrate 31. Another flexible member provided with the stationary contact 52B also has a shape like the flexible member having the stationary contact 52A. Each of the switch connection terminals 52C and 52D having a tip end extending downwardly below the underside surface of the substrate 31 and is the same feature as the connection terminals 39D, 39E and 39F of the rotary encoder.

Support legs 55 are provided on the flat underside surface at both ends of the substrate 31 to mount the REPS on a wiring board of an apparatus.

The REPS of this exemplary embodiment is constructed as has been described above.

Figure 8:
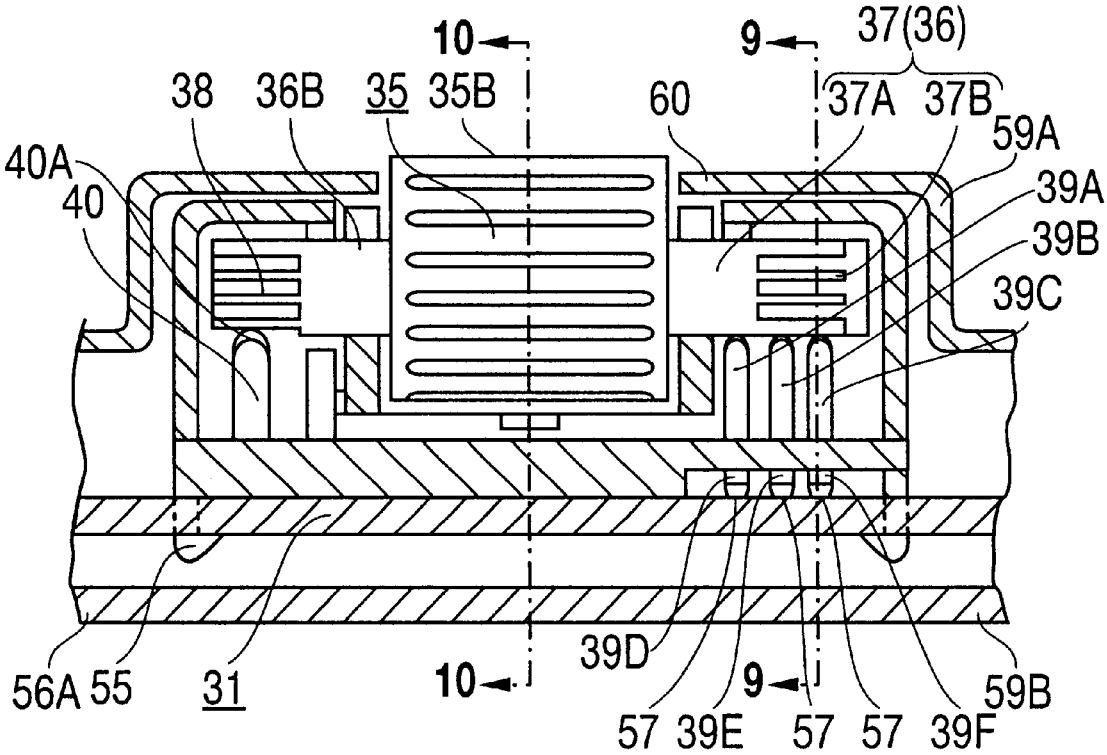
FIG. 8 is a partially sectioned view of an apparatus equipped with the REPS shown in FIG. 1, as viewed from a front side.
Figure 9:
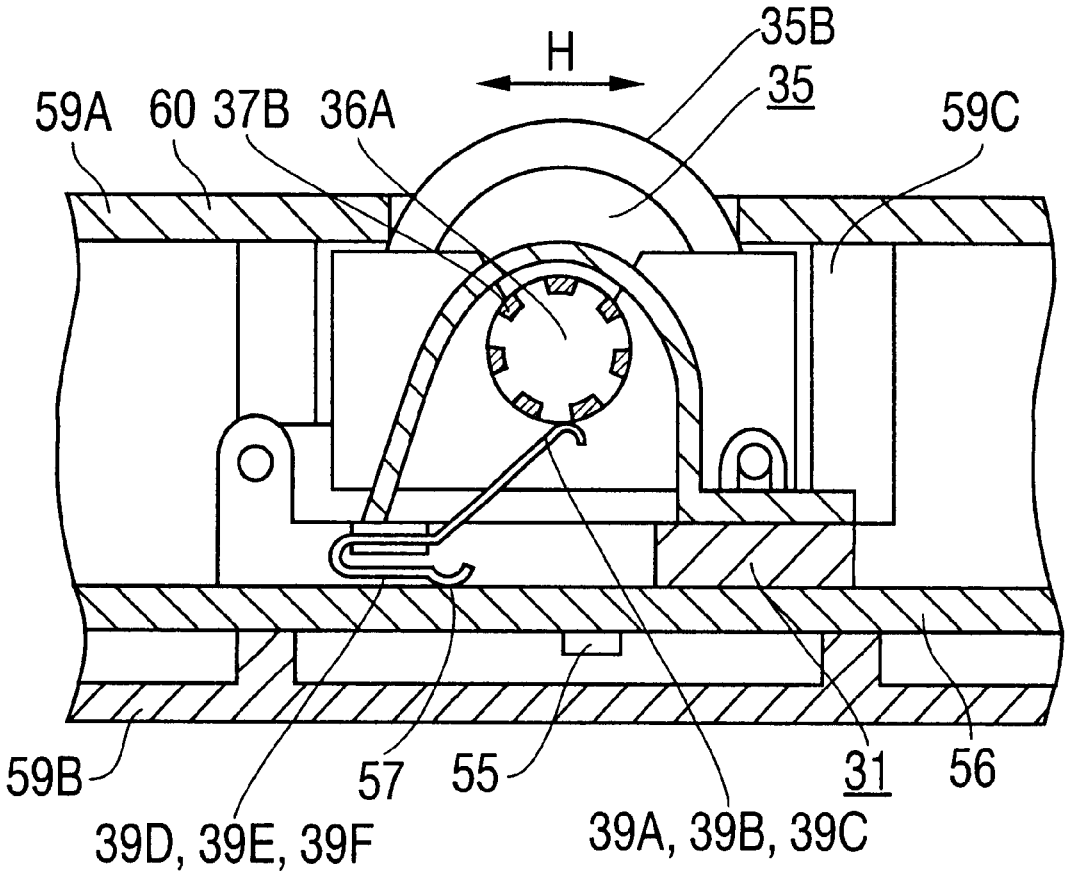
FIG. 9 is a sectional view taken along a line 9—9 in FIG. 8.

FIG. 8 is a partially sectioned front view depicting an instance where the REPS of this exemplary embodiment is mounted in an end-use apparatus. FIG. 9 is a sectional view taken along a line 9—9 in FIG. 8. The REPS of this exemplary embodiment is positioned with respect to the wiring board 56, and mounted by inserting the support legs 55 on the underside of the substrate 31 into mounting holes 56A in the wiring board 56 of the apparatus, as shown in FIG. 9. When mounted as above, the connection terminals 39D, 39E and 39F and the switch connection terminals 52C and 52D (refer to FIG. 7) protruding below the underside surface of the substrate 31 come into contact resiliently with their respective contact surfaces 57 and 58 (not shown in the figures) on the wiring board 56.

Further, when an upper enclosure 59A and a lower enclosure 59B of the apparatus are assembled together, a pressing rib 59C provided on the upper enclosure 59A presses an upper surface of the substrate 31 of the REPS on the wiring board 56 held on the lower enclosure 59B against the lower enclosure 59B. The REPS is secured to the apparatus by this pressure. In addition, the connection terminals 39D, 39E and 39F, and the switch connection terminals 52C and 52D are securely connected with resilient pressure to the individual contact surfaces 57 and 58 on the wiring board 56. A peripheral surface 35B of the knob portion 35 of the rotary body 34 protrudes above a control surface 60 of the upper enclosure 59A, to serve as a control portion, in this arrangement.

In this way, the REPS of this exemplary embodiment can attain connections of the individual connection terminals 39D, 39E and 39F, and the switch connection terminals 52C and 52D, simply by securing it with pressure against the wiring board 56 in the end-use apparatus. Therefore, the REPS of this exemplary embodiment avoids deformation due to heat, contamination due to soldering flux and the like, during solder connections when mounting it in the end-use apparatus. In addition, the REPS of this exemplary embodiment can be made even less costly, since it does not necessitate the use of a heat resistant plastic for the substrate 31 and other components.

The REPS of this exemplary embodiment constructed as above operates in a manner, which will be described next.

With reference to FIG. 8 and FIG. 9, the operator first applies a force in the tangential direction (the direction of an arrow H shown in FIG. 9) on the peripheral surface 35B of the knob portion 35 of the rotary body 34 protruding above the control surface 60 of the apparatus. This force of the tangential direction causes the rotary body 34 to rotate. The rotation also renders the cylindrical axles 36A and 36B to rotate, thereby operating the rotary encoder.

In other words, the flexible contact bars 39A, 39B and 39C retained by the substrate 31 slide on the cylindrical movable contact 37A and the comb-tooth shaped movable contact 37B on the cylindrical axle 36A while maintaining resilient contacts thereto. This sliding movement generates electric signals (pulse signals), respectively, between the connection terminals 39D and 39E, and between 39D and 39F having continuities to their respective flexible contact bars 39A, 39B and 39C. The signals are transferred to a circuit of the apparatus through the contact surfaces 57 on the wiring board 56. In addition, the detent 40A of the plate spring 40 extending from the substrate 31 slides resiliently around the annularly undulated surface 38 on the cylindrical axle 36B. The sliding produces click feels corresponding to the electric signals. The detent 40A of the plate spring 40 is maintained in one of the ditches of the annularly undulated surface 38, when rotation of the knob portion 35, i.e. the rotary body 34, stops.

In this embodiment, where points of the flexible contact bars 39B and 39C make contact with the comb-tooth shaped movable contact 37B, are shifted. This shift produces a delay in phase between an electric signal generated between the connection terminals 39D and 39E, and another electric signal generated between the terminals 39D and 39F. The circuit of the end-use apparatus can detect a rotating direction and a rotating angle of the rotary body 34 (i.e. the knob portion 35) according to the delay in phase.

When the rotary body 34, that is, the knob portion 35 is not manipulated, the two flexible contact bars 39B and 39C stay in contact with the insulated surface of the comb-tooth shaped movable contact 37B. Even if the rotary body 34 is rotated from this position, the flexible contact bars 39B and 39C stop at positions in contact with another insulated surface again. Therefore, this rotary encoder consumes no electric power except when it is rotated.

The rotary body 34 retained in the frame 33 is kept biased upwardly by the three flexible contact bars 39A, 39B and 39C, and the plate spring 40. Therefore, the side 44B of the frame 33 provided with the depressing boss 44C for the push switch 41 does not move downward during normal rotary manipulation of the knob portion 35. There can be cases in that the flexible contact bars 39A, 39B and 39C, and the plate spring 40 are depressed and bent slightly when a depressing force is applied downwardly on the knob portion 35 during a rotary manipulation. However, the push switch 41 of self-restoring type is so devised as not likely to turn on easily, even if the frame 33 turns slightly and the side 44B having the depressing boss 44C shifts downward.

Figure 10:
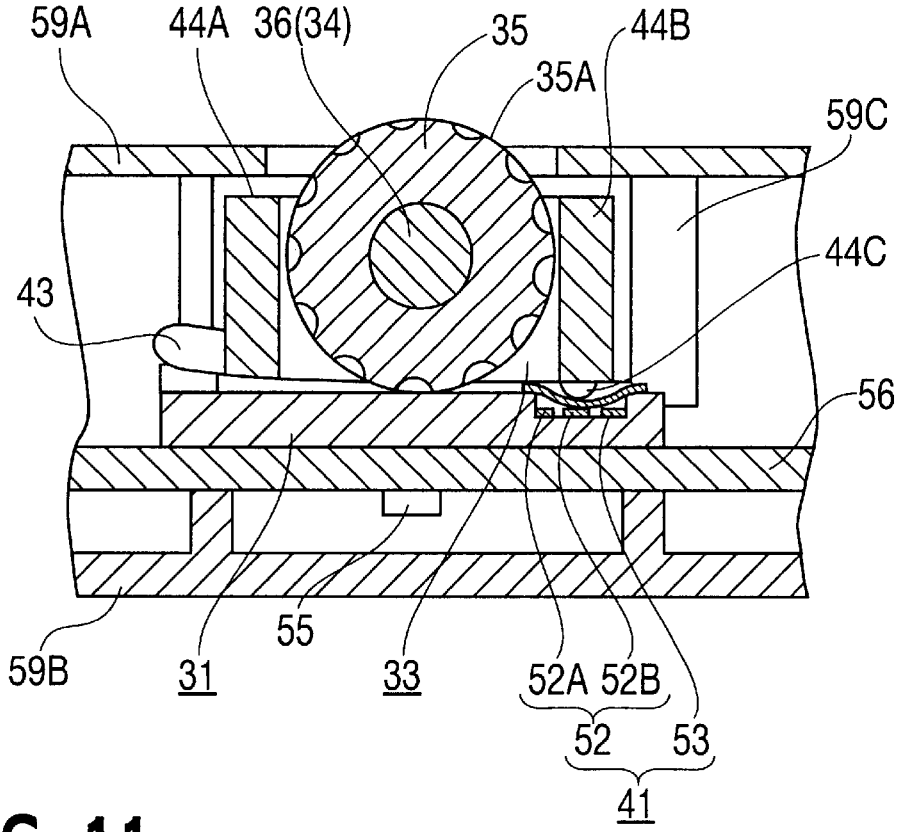
FIG. 10 is a sectional view taken along a line 10—10 in FIG. 8.

FIG. 10 is a sectional view taken along a line 10—10 in FIG. 8. When a downward depressing force is applied to the peripheral surface 35B of the knob portion 35, the frame 33 turns about the axial pins 43 supported by the substrate 31. This turning motion causes the depressing boss 44C on the lower surface of the side 44B to shift downward, to actuate the push switch 41. In other words, the depressing boss 44C pushes an upper center portion of the discoidal dome-shaped movable contact 53 hard downward through the flexible insulation film 54. This makes the discoidal dome-shaped movable contact 53 deform resiliently into a reversed shape, as shown in FIG. 10, with a click feel. The reversing deformation causes an underside surface in the center of the discoidal dome-shaped movable contact 53 to come in contact with the center stationary contact 52B. This results in a continuity between the outer stationary contact 52A and the center stationary contact 52B of the switch 52 (i.e., between the switch connection terminals 52C and 52D) thereby turning the switch on. An ON signal through the switch connection terminals 52C and 52D is transferred to the circuit in the apparatus via the contact surfaces 58 (not show in the figures) on the wiring substrate 56. Here, the downward depressing force needs to be greater than a total of forces of the three flexible contact bars 39A, 39B and 39C and the plate spring 40 (not show in FIG. 10) biasing the, rotary body 34 upwardly, and the restoring force of the push switch 41.

When the depressing force applied to the knob portion 35 is removed thereafter, the discoidal dome-shaped movable contact 53 is restored to its original shape by its own resilient restoring force. This turns the continuity again into an OFF state between the switch connection terminals 52C and 52D. The depressing boss 44C on the side 44B is pushed back upward by the resilient restoring force of the movable contact 53. In addition, the frame 33 is also pushed up by the forces of the three flexible contact bars 39A, 39B and 39C, and the plate spring 40. Consequently, the frame 33 returns to its upper end position within the range of turning angle.

The depressing manipulation of this push switch 41 is an operation for pushing down the depressing boss 44C by making the frame 33 to turn about the axial pins 43 provided on the side 44A of the quadrangle thereof. Therefore, there is never a twisting stress to develop during the depressing manipulation. Hence, the knob portion 35 is moved smoothly irrespective of a position being pushed.

Furthermore, one of the ditches in the annularly undulated surface 38 provided on the cylindrical axle 36B of the rotary body 34 retained in the frame 33 receives the detent 40A of the plate spring 40 in resilient contact thereto (refer to FIG. 6). Therefore, the rotary body 34 does not rotate, when the push switch 41 is activated by turning the frame 33 with a depressing force applied-to the knob portion 35. Thus, the encoder does not make a rotational movement during activation of the push switch 41.

In addition, since the two flexible contact bars 39B and 39C remain in contact with the insulated surface of the comb-tooth shaped movable contact 37B during the depressing manipulation, there is never an erroneous signal generated as the encoder.

Further, the points where the two flexible. contact bars 39B and 39C make resilient contact with the movable contact 37B are arranged to be on a generally circular arc of turning movement of the center axis of the rotary body 34 when the frame 33 turns about the axial pins 43. This structure can reduce the deviation of the points where the two flexible contact bars 39B and 39C make resilient contact with the movable contact 37B during activation of the push switch 41 by turning the frame 33.

As has been described, this exemplary embodiment realizes a reduction in diameter of the movable contact 37 of the rotary encoder. Therefore, a diameter of the cylindrical knob portion 35 can be reduced and thereby, a height size of the end-use apparatus can be reduced. In addition, the push switch 41 of this exemplary embodiment becomes smooth in operation, uses a lower number of components, is easy to assemble, and is less costly. Accordingly, this exemplary embodiment can realize a push and rotary operating type electronic component that is small in dimension, smooth in operation, easy to assemble, and less expensive.

In addition, the first exemplary embodiment is adaptable for another configuration of click mechanism in that the angular intervals of the ditches provided around the annularly undulated surface 38 of the rotary body 34 can be reduced to one half (or one quarter) of the angular intervals of the insulated surfaces of the comb-tooth shaped movable contact 37B. This click mechanism doubles (or quadruples) the number of click-feels produced per each rotation of the rotary body 34. With this configuration, the two flexible contact bars 39B and 39C having their signaling contact points shifted slightly from each other can produce different electric signals at each of the adjoining click positions. Accordingly, a number of counts of the electric signals can be doubled (or quadrupled) per each rotation of the rotary body.

Furthermore, at least those flexible contact bars (39B and 39C) in resilient contacts with the comb-tooth shaped movable contact 37B of the rotary body 34, among the plurality of flexible contact bars 39A, 39B and 39C retained by the substrate 31, are so arranged that they extend from positions on the substrate at a side nearer to the axial pin of the frame with respect to the center axis of the rotary body 34, and that points of the resilient contacts are on a generally circular arc of the center axis of the rotary body when the frame turns about the axial pins. This arrangement can reduce the deviation of the points where the flexible contact bars make resilient contact with the comb-tooth shaped movable contact during manipulation of the push operation part, thereby reducing a risk of erroneous operation of the rotary operation part.

Second Exemplary Embodiment

Figure 11:
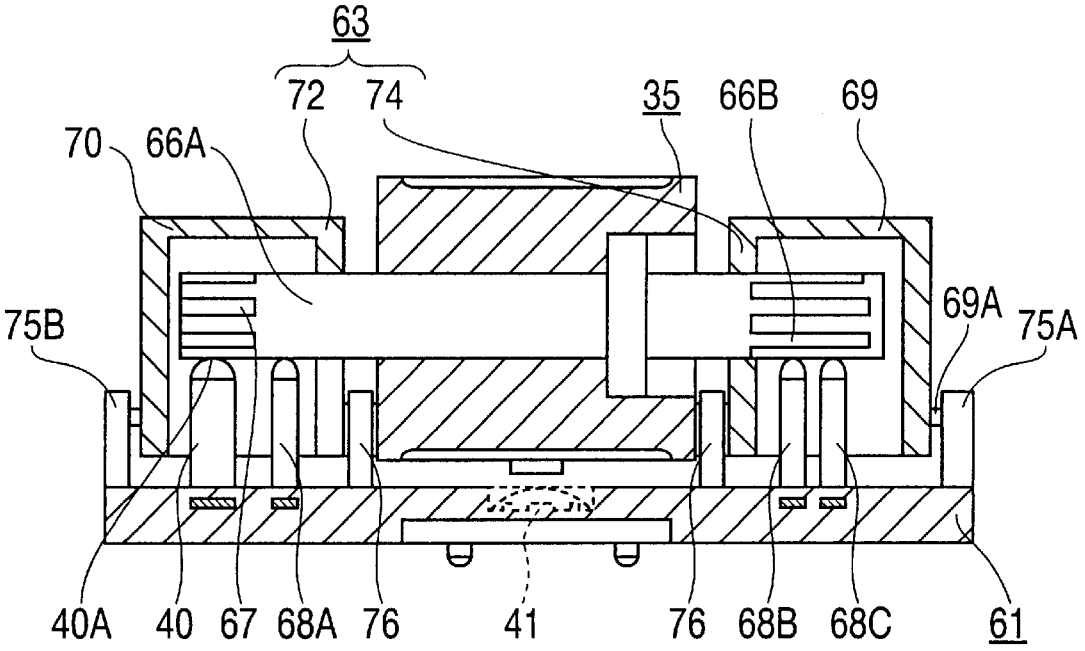
FIG. 11 is a sectional view of an essential portion of a REPS of a second exemplary embodiment of the present invention, as viewed from a front side.
Figure 12:
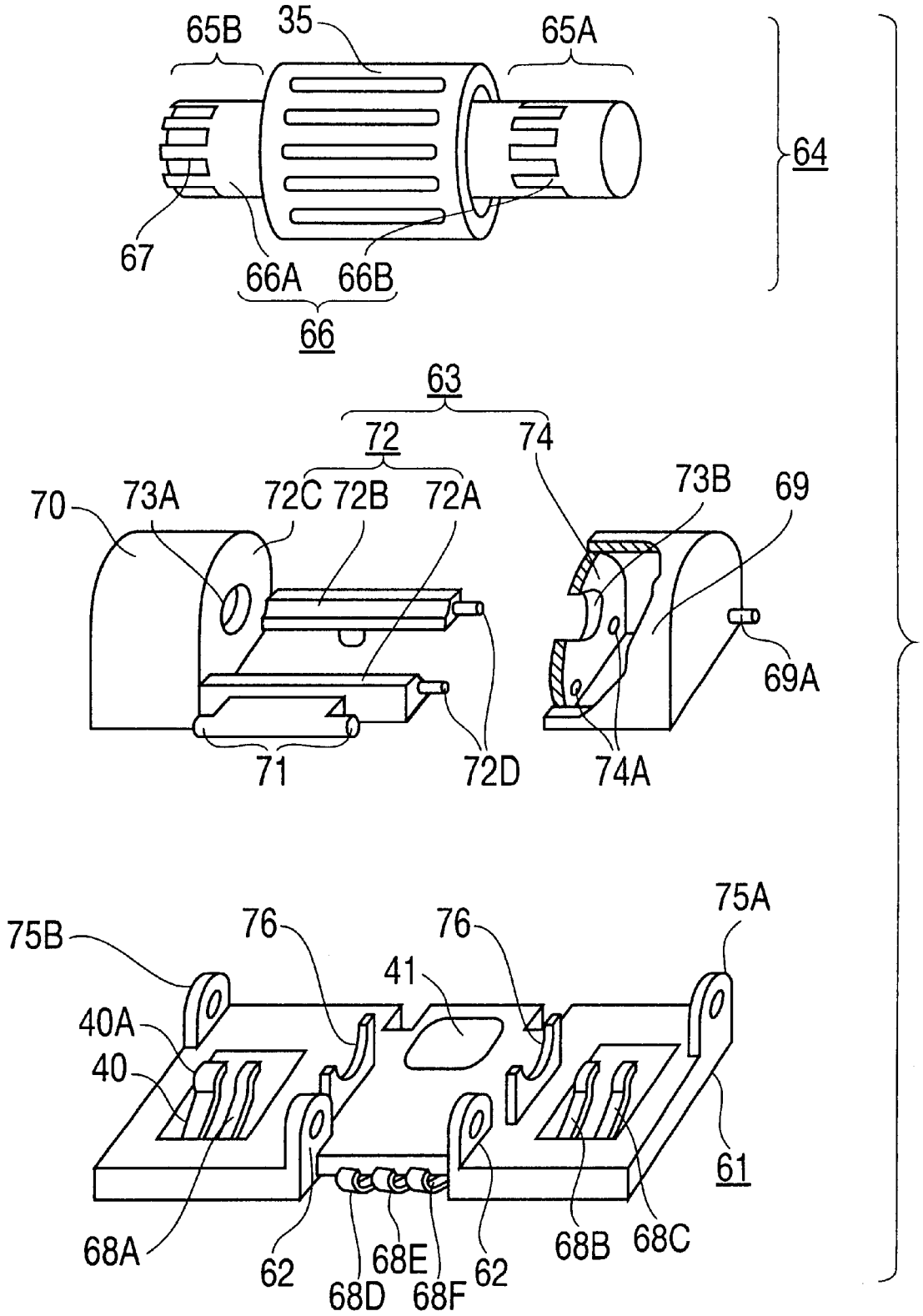
FIG. 12 is an exploded perspective view of the REPS shown in FIG. 11.

FIG. 11 is a sectional view of a REPS of a second exemplary embodiment of the present invention as viewed from a front side. FIG. 12 is an exploded perspective view of the REPS shown in FIG. 11.

The REPS of this exemplary embodiment represents another structure in which changes are made on parts of the REPS of the first exemplary embodiment. The changes pertain to setting positions of movable contacts arranged on a cylindrical axle of a rotary body, and configurations of a frame rotatably supporting the rotary body and a cover on sides of the frame. Structures other than the parts altered from the first exemplary embodiment remain identical to those of the REPS of the first exemplary embodiment. Therefore, like components as those of the first exemplary embodiment are assigned the same reference numerals, and their description will be omitted. Description will be made in detail, hereinafter, only for portions that differ from those of the first exemplary embodiment.

In the REPS of this exemplary embodiment shown in FIG. 11 and FIG. 12, a quadrangular frame 63 is supported rotatably on a pair of frame supports 62 of a substrate 61 made of insulation plastic resin. A rotary body 64 is retained rotatably in the quadrangular frame 63. The rotary body 64 is formed in such a configuration that it has a cylindrical knob portion 35 of large diameter in its center, and cylindrical axles 65A and 65B of small diameter at both of its sides. Therefore, the rotary body 64 has a cylindrical shape with a stepped-periphery. The cylindrical axle 65A of the knob portion 35 is only provided with a comb-tooth shaped movable contact 66B, and the cylindrical axle 65B is provided with a cylindrical movable contact 66A and an annularly undulated surface 67. The comb-tooth shaped movable contact 66B is in contact resiliently with two flexible contact bars 68B and 68C retained by the substrate 61. The annularly undulated surface 67 is kept in resilient contact with a detent 40A on a plate spring 40 extending from the substrate 61, and the movable contact 66A is kept in resilient contact with a flexible contact bar 68A retained by the substrate 61. In other words, the cylindrical axle 65A is in resilient contact with the two flexible contact bars 68B and 68C retained by the substrate 61, and the cylindrical axle 65B is in resilient contact with the detent 40A and the flexible contact bar 68A.

The substrate 61 and the rotary body 64 constitute a rotary encoder representing a rotary operation part.

The rotary body 64 of this exemplary embodiment is formed in the same manner as the process shown in FIGS. 4A, 4B, 4C and 4D for the rotary body 34 described in the first exemplary embodiment. Description will therefore be skipped for a method of forming the rotary body 64.

A push switch 41 of self-restoring type is disposed on the substrate 61 in a manner to operate with a turn of the frame 63, and dustproof covers 69 and 70 are mounted on both sides of the knob portion 35, in the like way as in the case of the first exemplary embodiment.

In the above structure, two flexible legs are provided in a projecting manner on both sides of the pair of frame supports 62 of the substrate 61, as shown in FIG. 12.

The comb-tooth shaped movable contact 66B and the cylindrical movable contact 66A arranged at both sides of the rotary body 64, with the knob portion 35 sandwiched in-between, are fabricated of a solid metallic material. Therefore, these movable contacts 66B and 66A are electrically continuous to each other. This feature is same as that of the first exemplary embodiment.

The rotary body 64 constructed as above is retained rotatably in the quadrangular frame 63. The quadrangular frame 63 is composed of a U-shaped section 72 and a side section 74 for bridging an open end of the U-shaped section 72, as shown in FIG. 12. The U-shaped section 72 comprises a side 72A having axial pins 71, another side 72B facing the side 72A, and yet another side 72C connecting the sides 72A and 72B. The side 72C has a circular hole 73A as a retaining means of the rotary body 64. The side section 74 has another circular hole 73B also as retaining means of the rotary body 64. The side 72C is provided with the dustproof cover 70 integrated with its exterior side for enclosing around the cylindrical movable contact 66A and the flexible contact bar 68A in resilient contact thereto. The side section 74 is also provided with the dustproof cover 69 integrated with its exterior side for enclosing around the comb-tooth shaped movable contact 66B and the flexible contact bars 68B and 68C in resilient contact thereto. The covers 69 and 70 are provided with projections 69A and 70A, respectively, at same ends of their exterior sides. The projections 69A and 70A are inserted in restraining holes 75A and 75B provided in a manner so as to face with each other near corners of the substrate 61, to restrict an extent of a turning angle of the frame 63.

The next portion of the description pertains to a method of assembling the quadrangular frame 63 to retain the rotary body 64 in it. When the U-shaped section 72 and the side section 74 for bridging the open end of the U-shaped section 72 are connected, the cylindrical axle 65B is inserted in advance into the circular hole 73A in the side 72C, and the cylindrical axle 65A, also in advance, into the circular hole 73B in the side section 74. Subsequently, a dowel 72D at each end of the sides 72A and 72B of the U-shaped section 72 is inserted into each of two small holes 74A in the side section 74. The U-shaped section 72 and the side section 74 are connected by fixing tips of the dowels 72D with thermal clinching or the like method. With this connection, assembly of the quadrangular frame 63 is completed. The connection of the U-shaped section 72 and the side section 74 also retains the rotary body 64 in the quadrangular frame 63.

Since the structure of the substrate 61 provided with a push switch 41 is similar to that of the first exemplary embodiment, a detailed description will be skipped. However, connection terminals 68E, 68F, and 68D of the rotary encoder are positioned in a mid-portion between the pair of frame supports 62 of the substrate 61, because the flexible contact bars 68B, 68C, and 68A are arranged separately, at both sides of the pair of frame supports 62.

There are two barriers 76, each of which is provided next to the flexible contact bars 68B and 68A, respectively, on the substrate 61, to prevent dust from entering into contact spaces in the same manner as the covers 69 and 70.

In addition, the structure of the three flexible contact bars 68A, 68B and 68C which make resilient contact with the movable contacts 66A and 66B of the rotary body 64, as well as the configuration of the push switch 41 are similar to those described in the first exemplary embodiment.

Furthermore, the REPS of this exemplary embodiment is mounted in an end-use apparatus, and operates in a like manner as in the case of the first exemplary embodiment. Thus, no further description will be made.

In this exemplary embodiment, as described above, the three flexible contact bars 68A, 68B and 68C, and the plate spring 40 are arranged evenly with two at each side next to the pair of frame supports 62 of the substrate 61, or the knob portion 35. Therefore, the REPS can be composed to be smaller in width, since it is laterally symmetrical. This can make the REPS of this exemplary embodiment easy to assemble, thereby reducing damage to the contact points, and so on, during the assembly.

In addition, this second exemplary embodiment is also adaptable for a configuration of click mechanism wherein the angular intervals of ditches provided around the annularly undulated surface 67 of the rotary body 64 are reduced to one half (or one quarter) of the angular intervals of the insulated surfaces of the comb-tooth shaped movable contact 65B in the same manner as the first exemplary embodiment, to attain a like effectiveness. Further description will therefore be skipped.

Third Exemplary Embodiment

Figure 13:
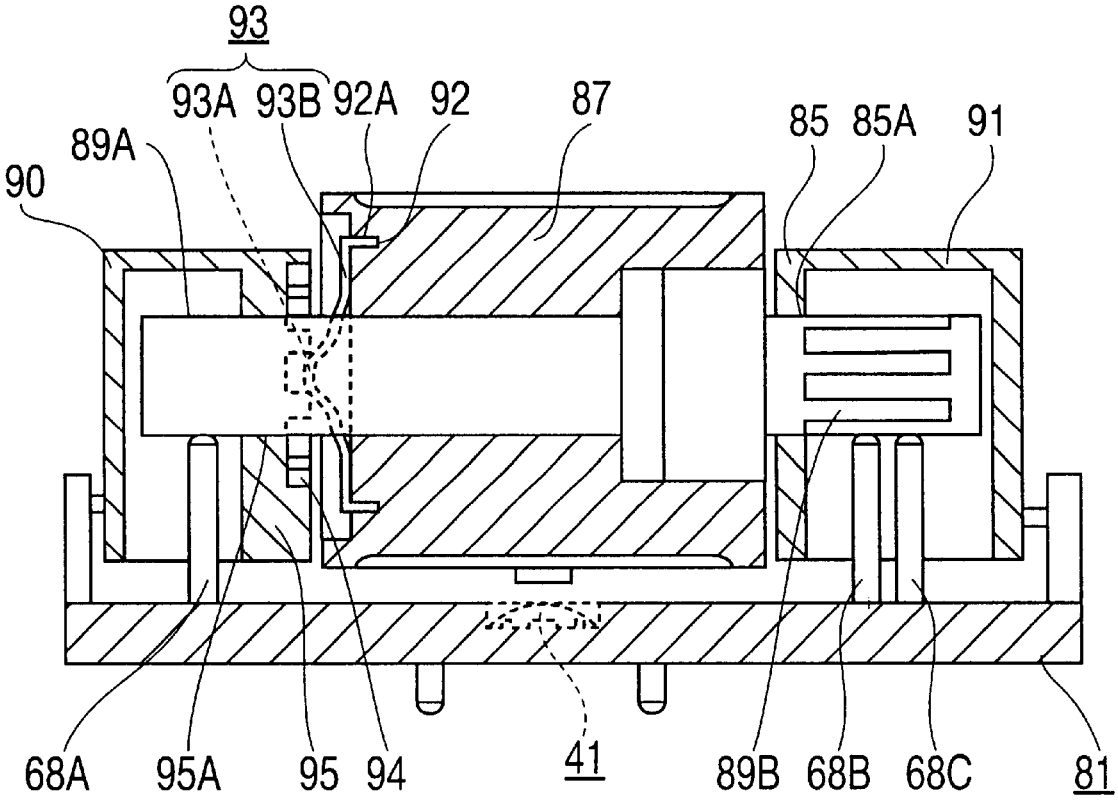
FIG. 13 is a sectional view of an essential portion of a REPS of a third exemplary embodiment of the present invention, as viewed from a front side.
Figure 14:
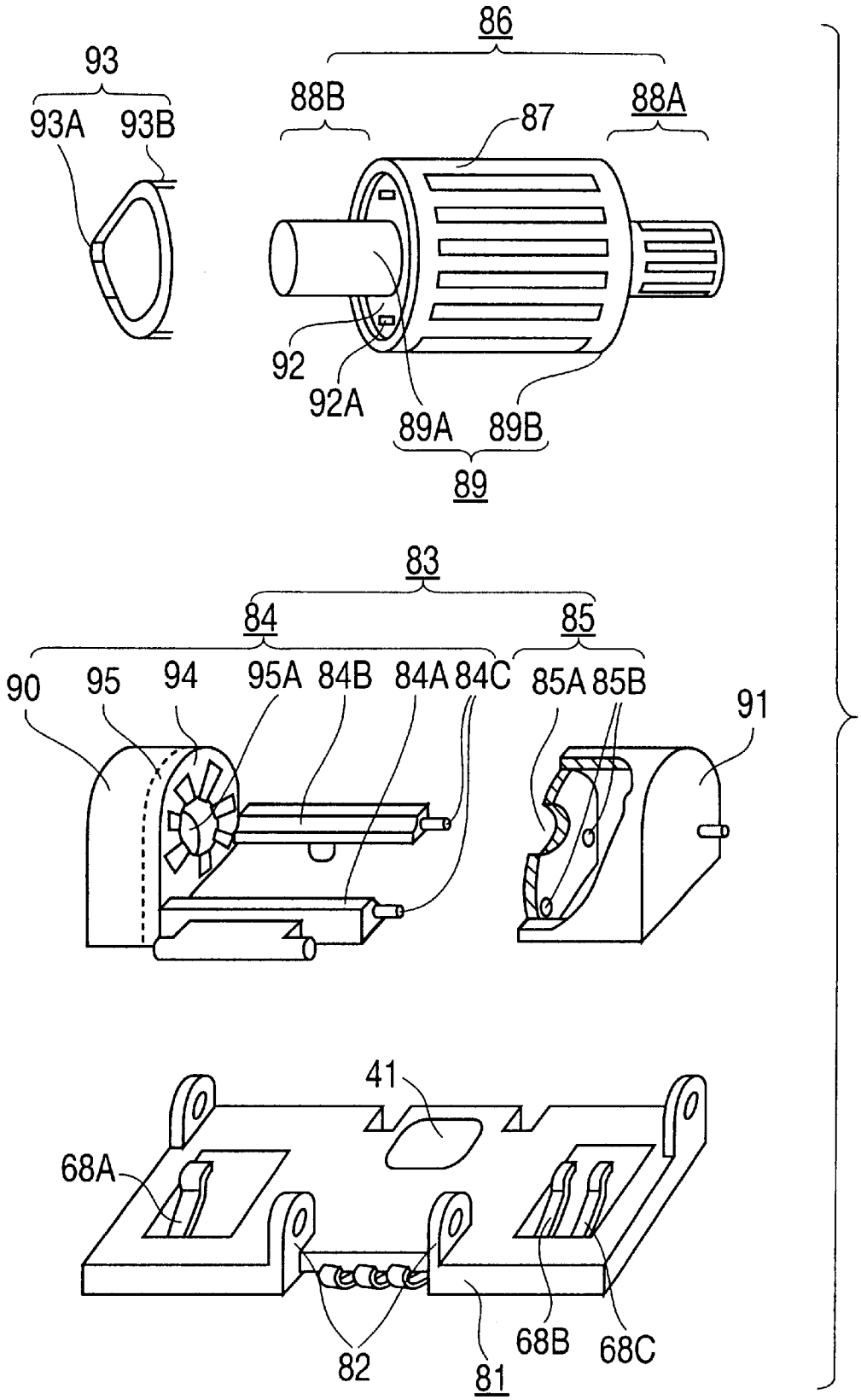
FIG. 14 is an exploded perspective view of the REPS shown in FIG. 13.
Figure 15:
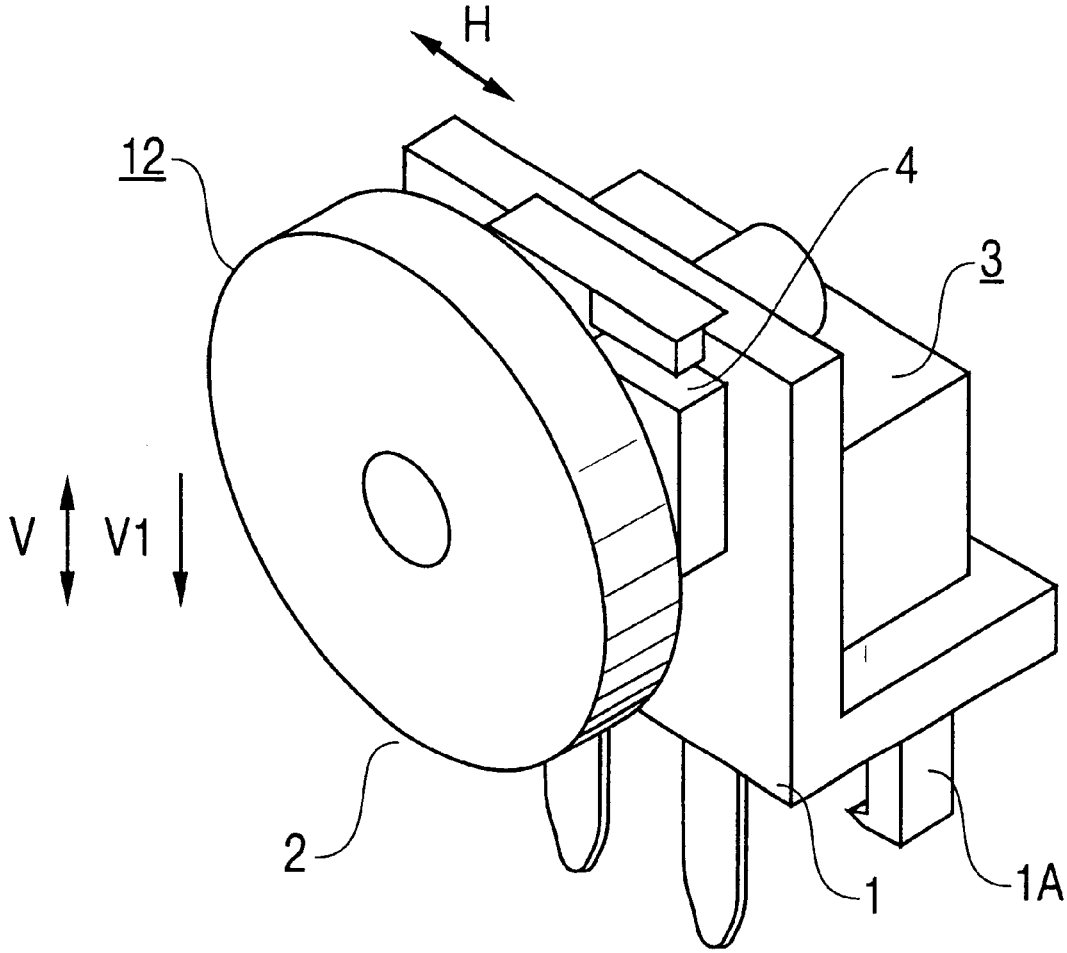
FIG. 15 (PRIOR ART)
FIG. 15 is a general perspective view of a REPS of the prior art.
Figure 16:
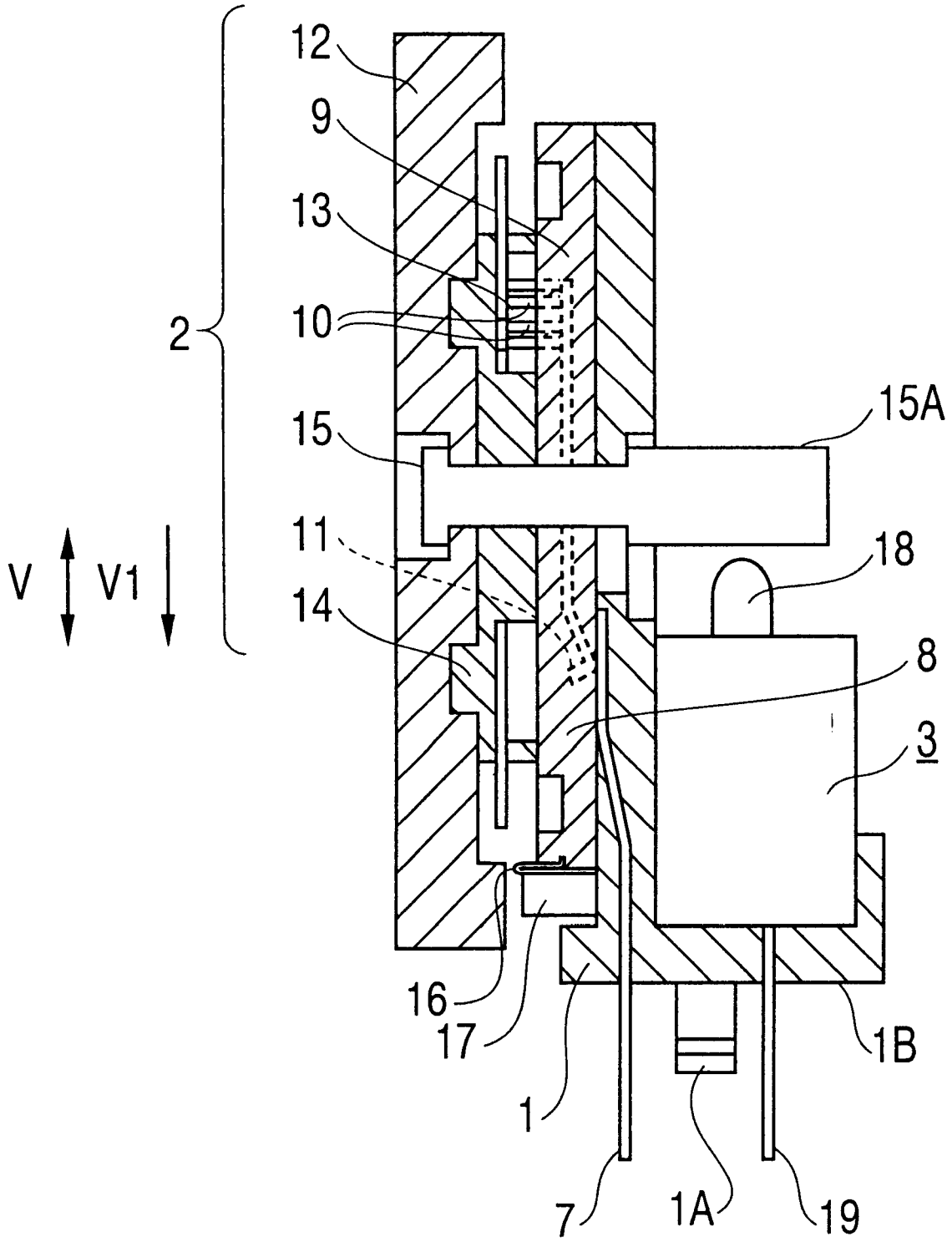
FIG. 16 (PRIOR ART)
FIG. 16 is a cross-sectional side view of the REPS of the prior art shown in FIG. 15.
Figure 17:
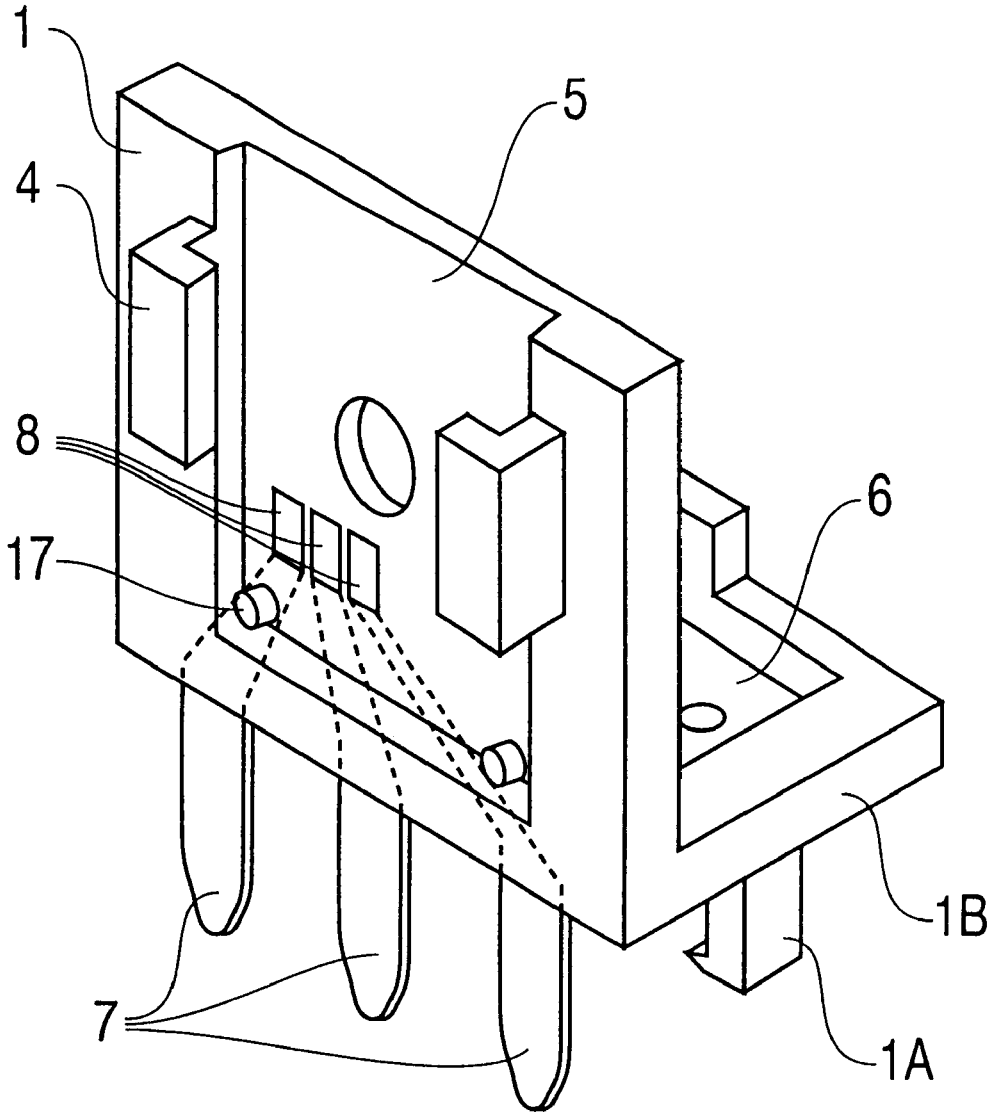
FIG. 17 (PRIOR ART)
FIG. 17. is a general perspective view of a mounting substrate having contact points, which is an essential portion of the REPS of the prior art shown in FIG. 15.
Figure 18:
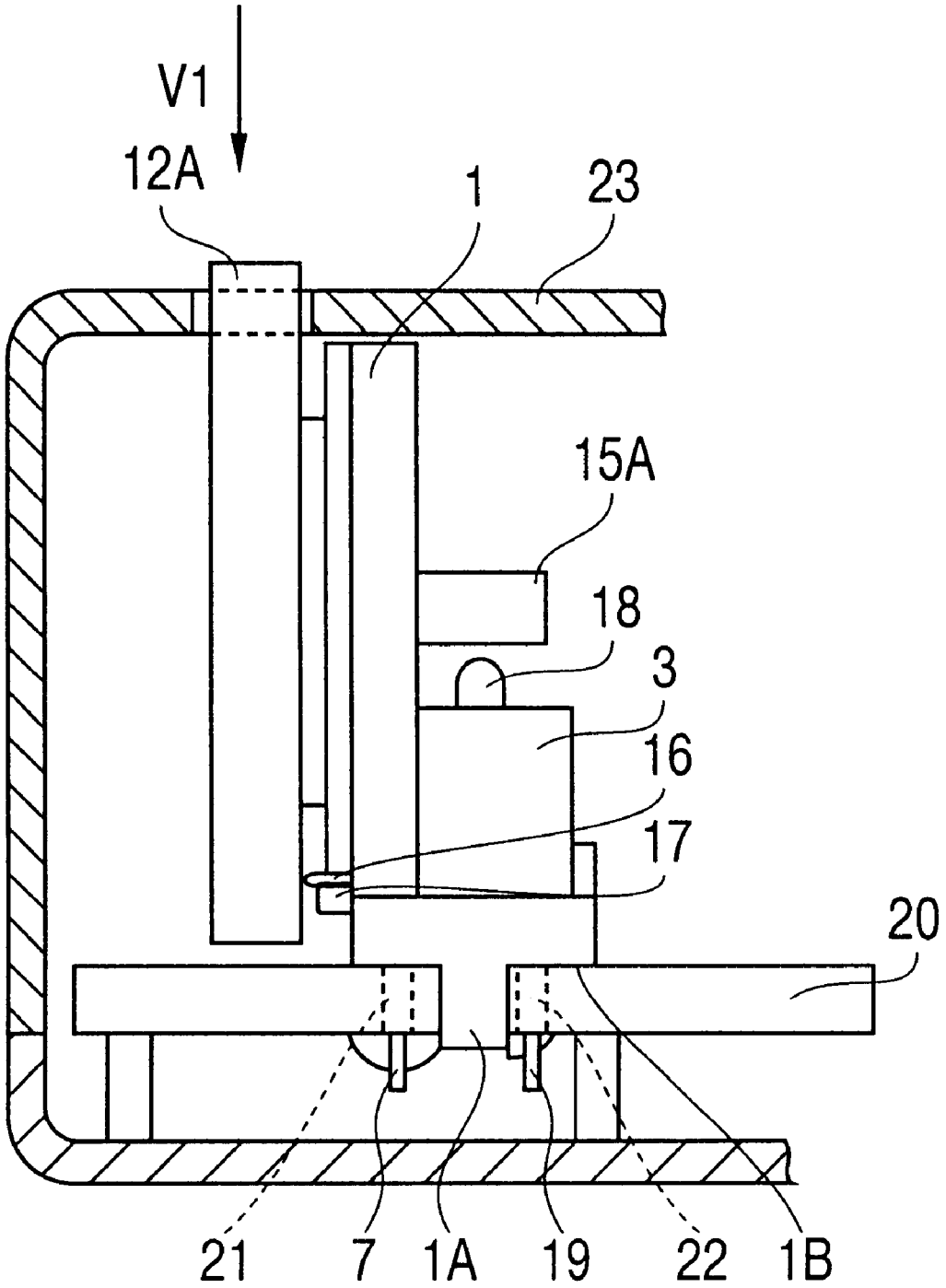
FIG. 18 (PRIOR ART)
FIG. 18 is a partially sectioned view of an apparatus equipped with the REPS of the prior art shown in FIG. 15, as viewed from a side thereof.
Figure 19:
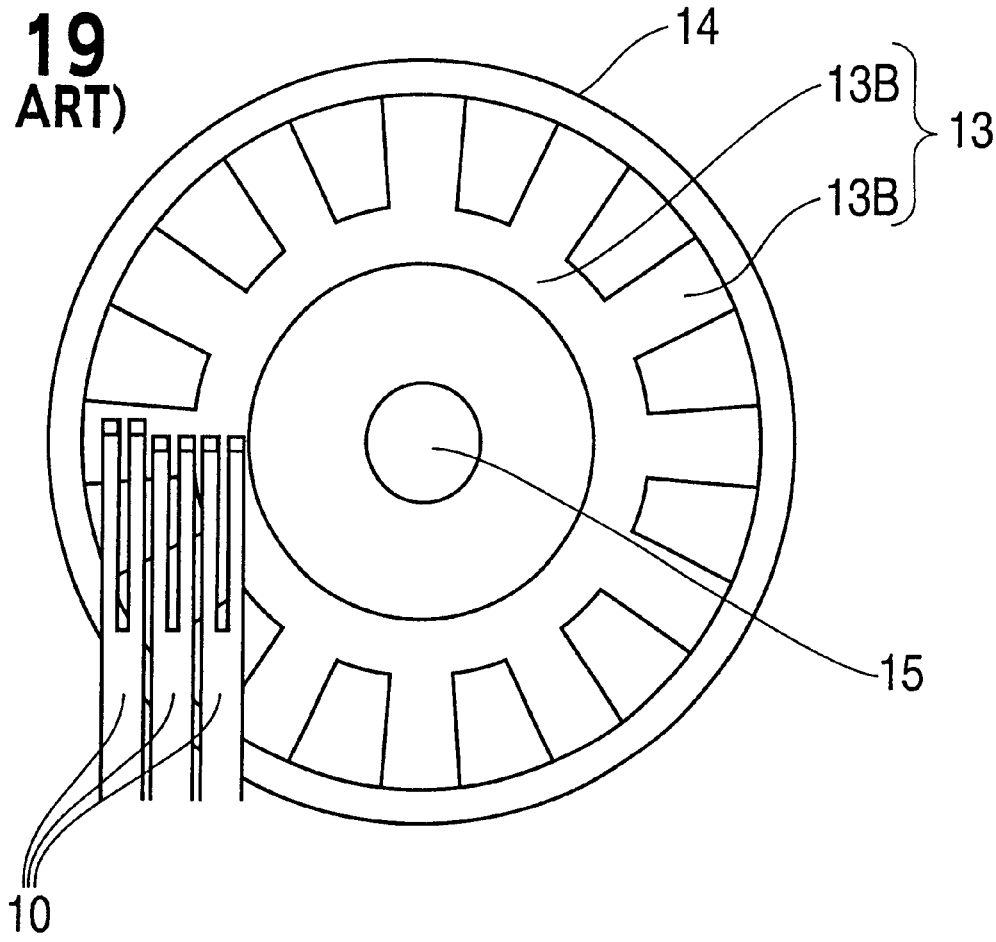
FIG. 19 (PRIOR ART)
FIG. 19 is a plan view depicting a contact portion of the REPS of the prior art shown in FIG. 15.

FIG. 13 is a sectional view of a REPS of a third exemplary embodiment of the present invention, as viewed from a front side. FIG. 14 is an exploded perspective view of the REPS shown in FIG. 13.

The REPS of this exemplary embodiment employs a change from the REPS of the second exemplary embodiment for a method of composing a click mechanism that produces click feels corresponding to a generation of electric signals when a knob portion is rotated. Since other structures remain identical to those of the REPS of the second exemplary embodiment, like components are assigned like reference numerals, and their descriptions will be omitted.

Description will be made in detail, hereinafter, only for portions that differ from those of the second exemplary embodiment.

In the REPS of this exemplary embodiment shown in FIG. 13 and FIG. 14, a quadrangular frame 83 is supported rotatably by a pair of frame supports 82 on a substrate 81 made of an insulation plastic resin. The quadrangular frame 83 is composed of a U-shaped section 84 and a side section 85 connected to the U-shaped section 84 for bridging an open end the U-shaped section 84. A rotary body 86 is retained rotatably in the quadrangular frame 83. The rotary body 86 is composed of a cylindrical knob portion 87 of large diameter in its center, and cylindrical axles 88A and 88B of small diameter at both of its sides. Therefore, the rotary body 86 has a cylindrical shape with a stepped-periphery. The cylindrical axle 88A of the knob portion 87 is provided with a comb-tooth shaped movable contact 89B on its peripheral surface, and the cylindrical axle 88B is provided with a cylindrical movable contact 89A. Two flexible contact bars 68B and 68C, retained by the substrate 81, are in contact resiliently with the comb-tooth shaped movable contact 89B, and a flexible contact bar 68A is in contact resiliently with the movable contact 89A.

The substrate 81 and the rotary body 86 constitute a rotary encoder representing a rotary operation part.

The rotary body 86 of this exemplary embodiment is formed in generally the same manner as the process shown in FIGS. 4A, 4B, 4C and 4D for the rotary body 34 described in the first exemplary embodiment. Description will therefore be skipped for a method of forming the rotary body 86.

A push switch 41 of self-restoring type is disposed on the substrate 81 in a manner to operate with turn of the frame 83, and dustproof covers 90 and 91 are mounted on exterior sides of the U-shaped section 84 and the side section 85 constituting the frame 83. This configuration is same as that of the second exemplary embodiment.

The cylindrical axle 88B of the rotary body 86 is provided only with a cylindrical movable contact 89A. Further, an annular spring 93 made of thin resilient sheet metal is placed on a stepped-end surface 92 of the rotary body 86 between the knob portion 87 and the cylindrical axle 88B. In addition, a surface of a side 95 of the frame 83 confronting the spring 93 is provided with a radially undulated surface 94 having ditches arranged in a radial orientation. Ridges and ditches of the radially undulated surface 94 are so formed that they have angular intervals equal to those of insulated surfaces of the comb-tooth shaped movable contact 89B of the rotary body 86. A resilient detent 93A bulging sideward from the spring 93 is in resilient contact with the radially undulated surface 94, to constitute a click mechanism.

Described hereinafter is a method of assembling the components in a manner that the resilient detent 93A of the annular spring 93 comes into resilient contact with the radially undulated surfaces 94 on the side 95 of the frame 83.

As shown in FIG. 14, two-angulated holes 92A are formed in the stepped-end surface 92 of the knob portion 87, and two tabs 93B are formed on the annular spring 93. First, each of the tabs 93B is inserted respectively into each of the angulated holes 92A, thereby mounting the annular spring 93 on the stepped-end surface 92 of the knob portion 87. The U-shaped section 84 and the side section 85 for bridging the open end of the U-shaped section 84 are connected under this condition in the same manner as in the case of the second exemplary embodiment. That is, the cylindrical axle 88B is inserted in advance into a circular hole 95A in the side 95, and the cylindrical axle 88A is also inserted in advance into a circular hole 85A in the side section 85. Subsequently, a dowel 84C at each end of sides 84A and 84B of the U-shaped section 84 is inserted into each of two small holes 85B in the side section 85. The U-shaped section 84 and the side section 85 are connected by fixing tips of the dowels 84C with thermal clinching or the like method. With this connection, assembly of the quadrangular frame 83 is completed. The connection of the U-shaped section 84 and the side section 85 also retains the rotary body 86 in the quadrangular frame 83.

Structures of other components of the REPS of this exemplary embodiment, a method of mounting it in an end-use apparatus, and the way it operates are same as those of the first and the second exemplary embodiments, and further descriptions will therefore be skipped.

With this exemplary embodiment, the cylindrical axle 88B of the rotary body 86 can be shortened. Accordingly, the REPS can be composed with a smaller width size.

What has been described above is the click mechanism having such a structure that the spring 93 is placed on the stepped-end surface 92 of the rotary body 86 between the knob portion 87 and the cylindrical axle 88B, and the radially undulated surface 94 is formed on the surface of the side 95 of the frame 83 confronting this spring 93. However, this arrangement may be reversed so that a radially undulated surface is formed on a side of the rotary body 86, and a spring is placed on a side of the frame 83.

Although the stepped-end surface 92 is formed in the rotary body 86 at a stepped periphery portion between the knob portion 87 and the cylindrical axle 88B, a stepped surface may be formed in the cylindrical axle by partially thickening its diameter.

In the third exemplary embodiment, a click mechanism can also be composed of the annularly undulated surface 94 of the rotary body 86, of which the angular intervals of the ditches are reduced to one half (or one quarter) of the angular intervals of the insulated surfaces of the comb-tooth shaped movable contact 89B, in the same manner as the first exemplary embodiment, so as to attain the like effectiveness. Further description of it will therefore be skipped.

As has been described, the present invention realizes a reduction in diameter of the movable contact for generating electric signals in the rotary operation part, thereby reducing a diameter of the cylindrical operating knob and a height size of the end-use apparatus. In addition, the invention realizes a push and rotary operating type electronic component that is smooth in operation as a push switch, yet is easy to assemble and is less expensive, as it requires a lower number of constituent components.

What is claimed is:

1. A push and rotary operating component comprising:

a rotary operation part comprising:

a substrate formed of an insulation material;

a frame support formed on said substrate;

a frame provided with an axial pin on one side thereof, said frame being rotatably supported by said frame support;

a cylindrical rotary body having a stepped periphery, said cylindrical rotary body comprising a cylindrical axle of small diameter provided with a movable contact on a peripheral surface thereof, and a large diameter portion serving as a knob portion, wherein said cylindrical rotary body is rotatably retained in said frame; and a plurality of flexible contact bars in resilient contact with said movable contact provided on the peripheral surface of said cylindrical axle of small diameter of said rotary body, said plurality of flexible contact bars being retained by said substrate; and a self-restoring push switch disposed on said substrate, wherein said self-restoring push switch operates when depressed with a turning movement of said frame.

2. The push and rotary electronic component as recited in claim 1, wherein said frame is a quadrangular frame.

3. The push and rotary electronic component as recited in claim 1, further comprising a plurality of flexibly depressible connection terminals, wherein said substrate is provided with a flat underside surface, said plurality of flexibly depressible connection terminals being in electrical continuity individually with said plurality of flexible contact bars of said rotary operation part and said self-restoring push switch, and said plurality of flexibly depressible connection terminals protrude below said flat underside surface of said substrate.

4. The push and rotation operating type electronic component as recited in claim 1, further comprising a click mechanism, said click mechanism comprising:

a radially undulated surface having radially-oriented ditches at predetermined angular intervals, said radially undulated surface being formed on one of a stepped-end surface between said knob portion and said cylindrical axle of said cylindrical rotary body, an end surface of a stepped periphery portion provided on said cylindrical axle, and a surface of said frame confronting said end surface of said stepped periphery portion; and a spring having a resilient detent in resilient contact with said radially undulated surface, said spring being disposed on a surface confronting said radially undulated surface.

5. The push and rotary electronic component as recited in claim 1, wherein said self-restoring push switch comprises:

a stationary contact provided in a predetermined position on said substrate; and a discoidal dome-shaped movable contact made of thin resilient sheet metal disposed on said stationary contact.

6. The push and rotary electronic component as recited in claim 1, wherein said substrate has a restraining hole, and said frame is provided with a projection formed near an end of a side facing said one side having said axial pin, said projection engaging the restraining hole provided in said substrate.

7. The push and rotary electronic component as recited in claim 1, wherein said knob portion of large diameter is cylindrical, formed of plastic resin and has a center hole, said cylindrical axle being inserted in the center hole of said cylindrical knob portion and connected with said cylindrical knob portion.

8. The push and rotary electronic component as recited in claim 1, further comprising a cover enclosing said moveable contact, said plurality of flexible contact bars in resilient contact with said moveable contact, and vicinities around said moveable contact and said flexible contact bars, and wherein said cylindrical axle of said cylindrical rotary body is rotatably retained at both sides near ends of said knob portion with two opposite sides of said frame in a manner such that said movable contact of said cylindrical axle is positioned at an exterior side of said two opposite sides of said frame.

9. The push and rotary electronic component as recited in claim 8, wherein said frame comprises a U-shaped section having a side having a retainer of said cylindrical rotary body, said side connecting two other sides facing each other, one of said two other sides having an axial pin, and another side section having another retainer of said cylindrical rotary body, said another side section bridging an open end of said U-shaped section, and wherein said cover is formed integrally at an exterior side of at least one of said side having said retainer and said another side section having said another retainer.

10. The push and rotary electronic component as recited in claim 1, wherein said moveable contact is an annular moveable contact and said cylindrical axle of said cylindrical rotary body is also provided with a comb-tooth shaped movable contact on said peripheral surface of said cylindrical axle, said comb-tooth shaped movable contact having conductive areas in continuity with said annular movable contact and insulated areas arranged alternately at predetermined angular intervals, wherein said annular moveable contact and said comb-tooth shaped movable contact make up a plurality of moveable contacts, and said plurality of flexible contact bars are in resilient contact with said plurality of movable contacts, wherein said rotary operation part is operable as a rotary encoder.

11. The push and rotary electronic component as recited in claim 10, wherein at least two of said plurality of flexible contact bars are in resilient contact with said comb-tooth shaped movable contact of said cylindrical rotary body, said at least two of said plurality of flexible contact bars being extended from positions on said substrate at a side nearer to said axial pin of said frame with respect to a center axis of said cylindrical rotary body, and said plurality of flexible contact bars make resilient contact at points located on a generally circular arc of said center axis of said circular rotary body when said frame makes the turning movement about said axial pin.

12. The push and rotary electronic component as recited in claim 10, wherein two of said plurality of flexible contact bars retained by said substrate are in resilient contact with said comb-tooth shaped movable contact of said cylindrical rotary body at points shifted slightly from each other by a predetermined distance.

13. The push and rotary electronic component as recited in claim 12, further comprising a plate spring having a detent at a tip thereof, said plate spring being retained by said substrate, wherein said cylindrical axle has an annularly undulated surface, said annularly undulating surface and said annular movable contact being provided on said peripheral surface of one side of said cylindrical axle next to said knob portion of said cylindrical rotary body, wherein said detent at said tip of said plate spring and one of said plurality of flexible contact bars retained by said substrate are kept in resilient contact with said annularly undulated surface and said annular moveable contact, respectively, and said comb-tooth shaped movable contact is provided on said peripheral surface of another side of said cylindrical axle, wherein said two of said plurality of flexible contact bars retained by said substrate are kept in resilient contact with said comb-tooth shaped moveable contact.

14. The push and rotary electronic component as recited in claim 1, further comprising a click mechanism, said click mechanism comprises:

an annularly undulated surface having ditches in parallel with a central axis of said cylindrical axle at predetermined angular intervals, said annularly undulating surface being formed around said peripheral surface of said cylindrical axle at a side of said knob portion of said cylindrical rotary body; and a plate spring extending from said substrate having a detent at a tip thereof in resilient contact with said annularly undulated surface.

15. The push and rotary electronic component as recited in claim 14, wherein one of said plurality of flexible contact bars retained by said substrate and in resilient contact with said movable contact of said cylindrical rotary body and said plate spring retained by said substrate and in resilient contact with said annularly undulated surface bias said cylindrical rotary body in a separating direction from said substrate.

16. The push and rotary electronic component as recited in claim 14, wherein said cylindrical rotary body further comprises a comb-shaped moveable contact having conductive surfaces and insulated surfaces located on said cylindrical rotary body, and the predetermined angular intervals of the ditches provided in said annularly undulated surface on said cylindrical axle of said cylindrical rotary body correspond with angular intervals of said conductive surfaces and said insulated surfaces of said comb-tooth shaped movable contact on said cylindrical rotary body, wherein points where two of said plurality of flexible contact bars make resilient contact with said comb-tooth shaped movable contact remain within one of said insulated surfaces, when said detent at said tip of said plate spring extending from said substrate is caught in one of the ditches in said annularly undulated surface.

* * * * *